US006463223B1

(12) United States Patent
Karakama et al.

(10) Patent No.: US 6,463,223 B1
(45) Date of Patent: Oct. 8, 2002

(54) ELECTROPHOTOGRAPHIC IMAGE FORMING APPARATUS, PROCESS CARTRIDGE DEVELOPING DEVICE, DEVELOPER SUPPLY CONTAINER AND MEASURING PART THEREFOR

(75) Inventors: Toshiyuki Karakama, Shizuoka-ken; Shirou Sakata; Hideki Matsumoto, both of Mishima; Akiyoshi Yokoi, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/411,394

(22) Filed: Oct. 4, 1999

(30) Foreign Application Priority Data

Oct. 9, 1998 (JP) ..... 10-303345

(51) Int. Cl.[7] ..... G03G 15/00; G03G 15/08

(52) U.S. Cl. ..... 399/27; 324/658; 399/44

(58) Field of Search ..... 399/27, 30, 58, 399/61, 62, 111, 258, 44, 97; 73/74; 324/658, 660, 663, 686, 676

(56) References Cited

U.S. PATENT DOCUMENTS

| | | | | |
|---|---|---|---|---|
| 4,133,453 A | * | 1/1979 | Ohbora | 399/61 X |
| 4,296,630 A | | 10/1981 | Jung et al. | 73/304 |
| 4,592,645 A | | 6/1986 | Kanai et al. | 399/63 |
| 4,786,869 A | | 11/1988 | Kanai et al. | 324/207.18 |
| 5,294,960 A | | 3/1994 | Nomura et al. | 399/113 |
| 5,365,319 A | * | 11/1994 | Sakemi et al. | 399/44 |
| 5,500,714 A | | 3/1996 | Yashiro et al. | 399/111 |
| 5,543,898 A | | 8/1996 | Shishido et al. | 399/111 |
| 5,585,895 A | | 12/1996 | Yashiro et al. | 399/103 |
| 5,617,579 A | | 4/1997 | Yashiro et al. | 399/114 |

(List continued on next page.)

FOREIGN PATENT DOCUMENTS

| | | | |
|---|---|---|---|
| EP | 0757303 A2 | | 2/1997 |
| JP | 52-153447 | | 12/1977 |
| JP | 59-51360 | | 4/1984 |
| JP | 63-210870 | * | 9/1988 |
| JP | 2-197880 | | 8/1990 |
| JP | 2-48934 | | 12/1990 |
| JP | 4-51064 | | 2/1992 |
| JP | 05-046025 | * | 2/1993 |
| JP | 5-188782 | | 7/1993 |
| JP | 05-100571 | | 8/1993 |
| JP | 7-306081 | | 11/1995 |

OTHER PUBLICATIONS

Patent Abstracts of Japan, vol. 17, No. 611 (P16–41), Nov. 10, 1993 (JP 5–188782).

Patent Abstracts of Japan, vol. 17, No. 451 (P–1595) Aug. 18, 1993 (JP 5–100571).

European Search Report (Ref. No.: 2684630) (dated Mar. 5, 2001).

*Primary Examiner*—Sophia S. Chen

(74) *Attorney, Agent, or Firm*—Fitzpatrick, Cella, Harper & Scinto

(57) ABSTRACT

An electrophotographic image forming apparatus includes a first electrostatic-capacity generating portion disposed at such a position that the first electrostatic capacity generating portion contacts the developer accommodated in the developer accommodating portion. The first electrostatic capacity generates portion generating an electrostatic capacity corresponding to an amount of the developer. A second electrostatic-capacity generating portion is disposed at such a position that the second electrostatic-capacity generating portion does not contact the developer accommodated in the developer-accommodating portion. The second electrostatic capacity generating portion generates a reference electrostatic capacity. A developer amount detector is provided for detecting an amount of the developer accommodated in the developer-accommodating portion on the basis of the electrostatic capacity generated by the first electrostatic-capacity generating portion and the reference electrostatic capacity generated by the said second electrostatic-capacity generating portion.

96 Claims, 21 Drawing Sheets

U.S. PATENT DOCUMENTS 5,623,328 A 4/1997 Tsuda et al. ..... 399/111
5,689,774 A 11/1997 Shishido et al. ..... 399/111
5,749,027 A 5/1998 Ikemoto et al. ..... 399/113
5,768,660 A 6/1998 Kurihara et al. ..... 399/111
5,774,766 A 6/1998 Karakama et al. ..... 399/111
5,802,420 A * 9/1998 Garr et al. ..... 399/27
5,812,909 A 9/1998 Oguma et al. ..... 399/103
5,828,928 A 10/1998 Sasago et al. ..... 399/111
5,861,758 A * 1/1999 Berberich ..... 324/676 X
5,873,012 A * 2/1999 Miyabe et al. ..... 399/111 X
5,890,036 A 3/1999 Karakama et al. ..... 399/119
5,899,602 A 5/1999 Noda et al. ..... 399/111
5,920,752 A 7/1999 Karakama et al. ..... 399/111
5,940,658 A 8/1999 Yokoi et al. ..... 399/119
5,943,528 A 8/1999 Akutsu et al. ..... 399/110
5,966,566 A 10/1999 Odagawa et al. ..... 399/109
5,987,269 A * 11/1999 Allen et al. ..... 399/27
6,028,433 A * 2/2000 Cheiky-Zelina et al. .... 324/663
6,223,131 B1 * 4/2001 Kanaya et al. ..... 399/27 X

* cited by examiner

ELECTROPHOTOGRAPHIC IMAGE FORMING APPARATUS, PROCESS CARTRIDGE DEVELOPING DEVICE, DEVELOPER SUPPLY CONTAINER AND MEASURING PART THEREFOR

FIELD OF THE INVENTION AND RELATED ART

The present invention relates to an electrophotographic image forming apparatus, a process cartridge therefor, a developing device therefor, a developer supply container therefor and a measuring part.

Here, the electrophotographic image forming apparatus includes an electrophotographic copying machine, an electrophotographic printer, for example, an LED printer or laser beam printer, an electrophotographic printer type facsimile, an electrophotographic printer type word, or the like.

The process cartridge is a cartridge containing, as a unit, an electrophotographic photosensitive member and at least one process means which is a charging means, a developing means or cleaning means, or a cartridge containing, as a unit, an electrophotographic photosensitive member and at least developing means as process means, the process cartridge being detachably mountable to a main assembly of an electrophotographic image forming apparatus.

Heretofore, a process cartridge widely is used in an image forming apparatus using an electrophotographic image forming process, is a process cartridge which contains as a unit an electrophotographic photosensitive member and process means actable on the electrophotographic photosensitive member, which cartridge is detachably mountable to the main assembly of the electrophotographic image forming apparatus. Such process cartridge is advantageous in that a maintenance operation can be carried out in effect by the users. Therefore, this process-cartridge type is widely used in electrophotographic image forming apparatus.

With such an electrophotographic image forming apparatus of a process-cartridge type, the user is supposed to exchange the process cartridge, and therefore, it is desirable that there is provided means by which the user is notified of the consumption of the developer.

Heretofore, it is known that two electrode rods are provided in the developer container of the developing means, and the change of the electrostatic capacity between the electrode rods is detected to provide the amount of the developer.

Japanese Laid-open Patent Application No. HEI-5-100571 discloses a developer-detection electrode member comprising two parallel electrodes disposed on the same surface with a predetermined gap, in place of the two electrode rods, wherein the developer-detection electrode member is placed on the lower surface of the developer container. It detects the developer remainder by detecting the change of the electrostatic capacity between the parallel electrodes disposed on a surface.

SUMMARY OF THE INVENTION

Accordingly, it is a principal object of the present invention to provide an electrophotographic image forming apparatus, a process cartridge, a developing device, a developer-supply container, and a measuring part that is capable of detecting the remaining amount of the developer substantially in real-time.

It is another object of the present invention to provide an electrophotographic image forming apparatus, a process cartridge, a developing device, and a developer-supply container that is capable of detecting a remaining amount of the developer in the developer-accommodating portion substantially in real-time in accordance with the consumption of the developer.

It is a further object of the present invention to provide an electrophotographic image forming apparatus, a process cartridge, a developing device, and a developer-supply container that is capable of detecting a remaining amount of the developer using a change in the electrostatic capacity between electrodes, wherein measurement errors are attributable to changes of the ambient conditions, thus minimizing the detection error.

It is a further object of the present invention to provide a measuring part for detecting an amount of the developer substantially in real-time in accordance with the consumption of the developer in the developer-accommodating portion.

It is a further object of the present invention to provide a measuring part capable of detecting a developer remainder using a change of the electrostatic capacity between electrodes, wherein the measurement error is attributable to the changes of the ambient conditions, to accomplish detection of the amount of the developer with a small detection error.

According to an aspect of the present invention, there is provided an electrophotographic image forming apparatus, a process cartridge, a developing device, and a developer-supply container wherein there is provided a measuring part comprising an insulative substrate; a first electrostatic-capacity generating portion disposed at such a position that the first electrostatic-capacity generating portion contacts the developer accommodated in the developer-accommodating portion when a predetermined amount of the developer is accommodated in the developer-accommodating portion, the first electrostatic-capacity generating portion generating an electrostatic capacity corresponding to an amount the developer when the first electrostatic-capacity generating portion is supplied with a voltage, and a second electrostatic-capacity generating portion disposed at such a position that second electrostatic-capacity generating portion does not contact to the developer accommodated in the developer accommodating portion, the second electrostatic-capacity generating portion generating a reference electrostatic capacity when the second electrostatic-capacity generating portion is supplied with a voltage, wherein the first electrostatic capacity generating portion and the second electrostatic capacity generating portion are provided on the substrate.

According to another aspect of the present invention, there is provided an electrophotographic image forming apparatus, a process cartridge, a developing device, and a developer supply container wherein there is provided a measuring part comprising an insulative substrate; a first electrostatic-capacity generating portion including first electroconductive portions and second electroconductive portions alternatingly arranged in parallel with each other at regular intervals and a second electrostatic-capacity generating portion including third electroconductive portions and fourth electroconductive portions alternatingly arranged in parallel with each other at regular intervals, wherein the first electrostatic capacity generating portion and the second electrostatic capacity generating portion are provided on the insulative substrate.

According to a father aspect of the present invention, there is provided a measuring part comprising an insulative substrate; a first electrostatic-capacity generating portion disposed at such a position that the first electrostatic-capacity generating portion contacts the developer accommodated in the developer-accommodating portion when a predetermined amount of the developer is accommodated in the developer-accommodating portion, the first electrostatic-capacity generating portion generating an electrostatic capacity corresponding to the amount of the developer when said first electrostatic-capacity generating portion is supplied with a voltage, and a second electrostatic-capacity generating portion disposed at such a position that the second electrostatic-capacity generating portion does not contact to the developer accommodated in said developer-accommodating portion, the second electrostatic-capacity generating portion generating a reference electrostatic capacity when the second electrostatic-capacity generating portion is supplied with a voltage, wherein the first electrostatic-capacity generating portion and the second electrostatic-capacity generating portion are provided on the substrate.

According to a further aspect of the present invention, there is provided a measuring part comprising an insulative substrate; a first electrostatic-capacity generating portion including first electroconductive portions and second electroconductive portions alternatingly arranged in parallel with each other at regular intervals and a second electrostatic-capacity generating portion including third electroconductive portions and fourth electroconductive portions alternatingly arranged in parallel with each other at regular intervals, wherein said first electrostatic-capacity generating portion and the second electrostatic-capacity generating portion are provided on the insulative substrate.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to a accompanying drawings, the description will be provided as to an electrophotographic image forming apparatus, a process cartridge, a developing device, a developer-supply container, and a measuring part.

(Embodiment 1)

Figure 1:
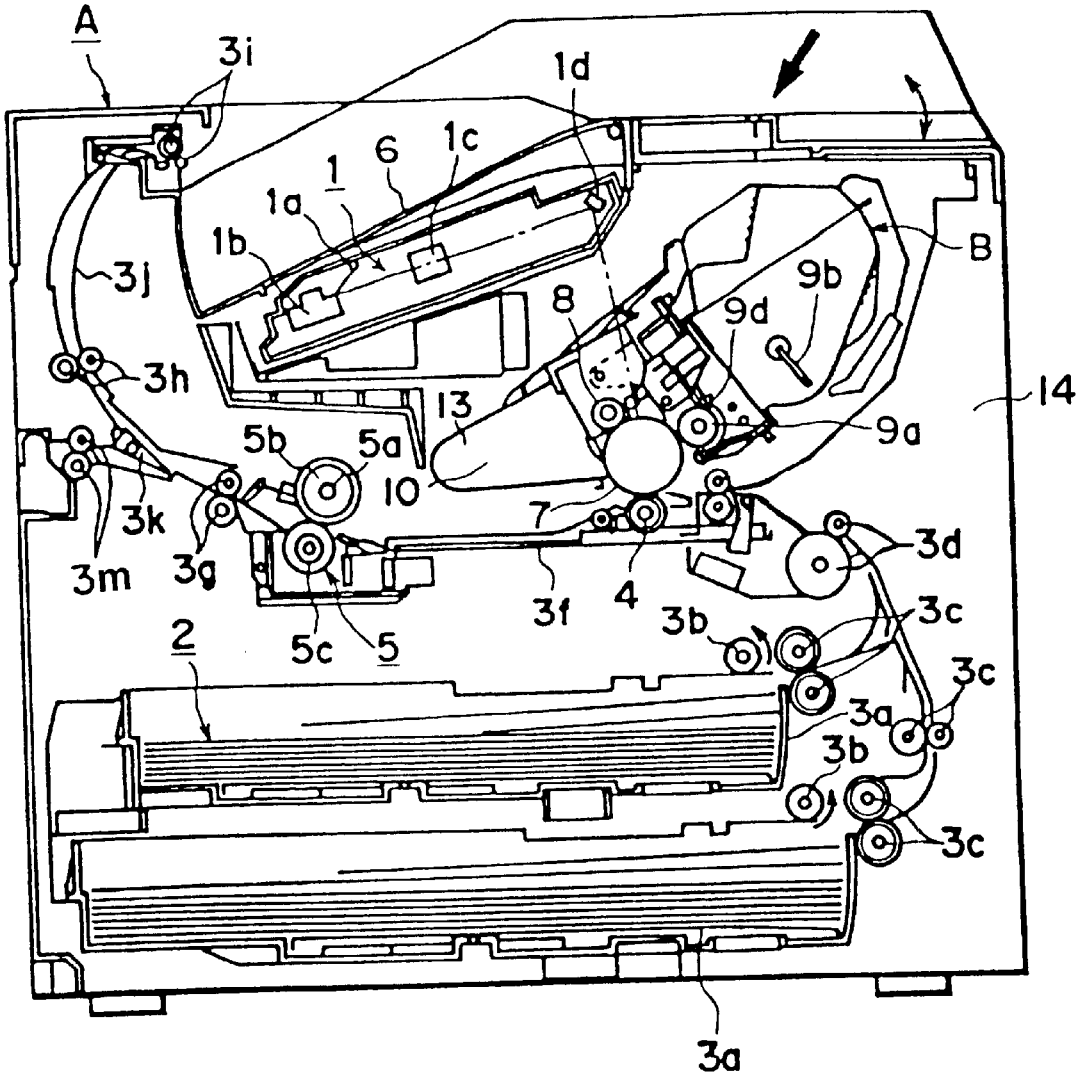
FIG. 1 shows a general arrangement of the electrophotographic image forming apparatus according to an embodiment of the present invention.
Figure 2:
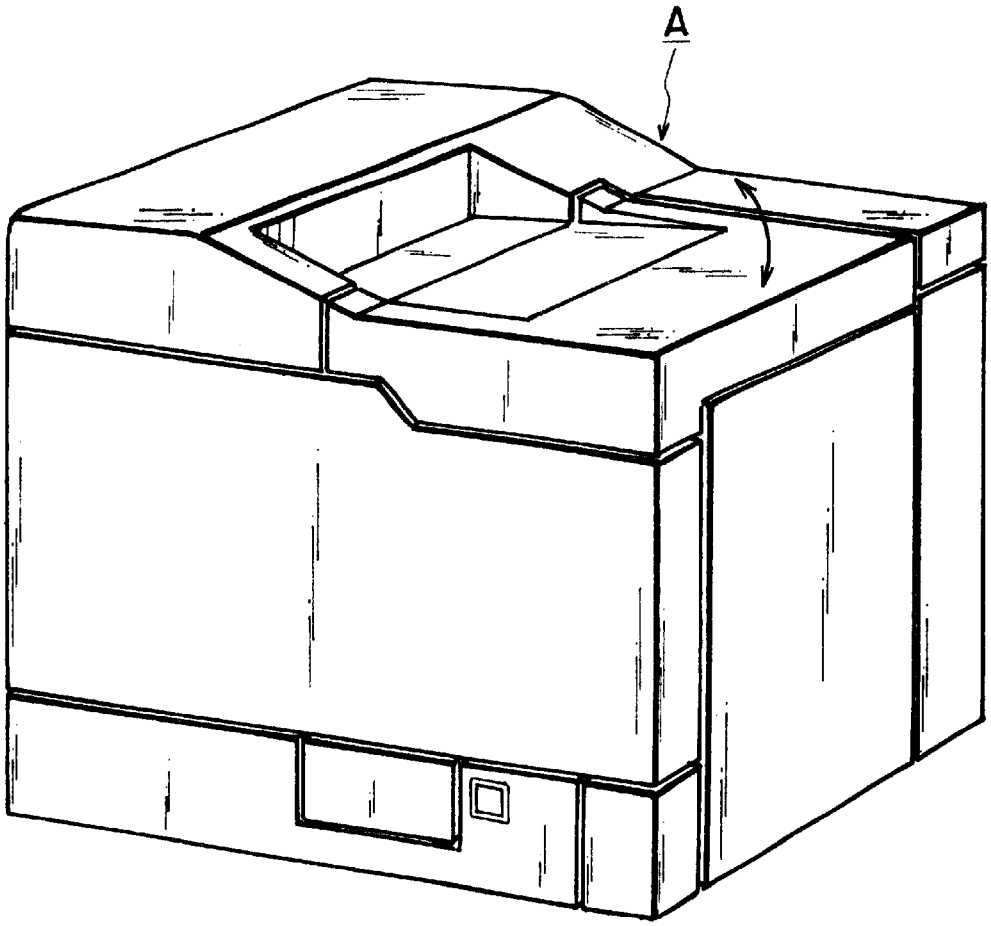
FIG. 2 is the perspective view of the outer appearance of an electrophotographic image forming apparatus according to an embodiment of the present invention.

Referring to FIG. 1, a description will be provided as to an electrophotographic image forming apparatus to which a process cartridge is a detachably mountable, according to one embodiment of the present invention. In this embodiment, the electrophotographic image forming apparatus is in the form of a laser beam printer A of an electrophotographic type in which images are formed on a recording material such as recording paper, or an OHP sheet or textile through an electrophotographic image forming process.

The laser beam printer A comprises an electrophotographic photosensitive member, that is, a photosensitive drum 7. The photosensitive drum 7 is electrically charged by a charging roller 8 (charging means), and is exposed to a laser beam modulated in accordance with image information coming from optical means 1 including a laser diode 1*a,* a polygonal mirror 1*b,* a lens 1*c,* and a reflection mirror 1*d,* so that a latent image is formed on the photosensitive drum in accordance with the image information. The latent image is developed by developing means 9 into a visualized image, that is, a toner image.

The developing means 9 includes a developer chamber 9A provided with a developing roller 9*a* (developer carrying member), wherein the developer in developer container 11A (developer accommodating portion) disposed adjacent to the developer chamber 9A is fed out to a developing roller 9*a* in the developer chamber 9A by rotation of a developer-feeding member 9*b.* The developer chamber 9A is provided with a developer-stirring member 9*e* adjacent to the developing roller 9*a* to circulate the developer in the developer chamber. The developing roller 9*a* contains therein a fixed magnet 9*c* so that developer is fed by rotation of the developing roller 9*a,* and the developer is electrically charged by triboelectric charge by friction with a developing blade 9*d,* and is formed into a developer layer having a predetermined thickness, which layer is supplied to a developing zone of the photosensitive drum 7. The developer the supplied to the developing zone is transferred onto the latent image on the photosensitive drum 7 so that the toner image is formed. The developing roller 9*a* is electrically connected with a developing-bias circuit which is normally supplied with a developing-bias voltage in the form of an AC voltage biased with a DC voltage.

On the other hand, a recording material 2 in a sheet-feeding cassette 3*a* is fed out and supplied to an image-transfer position by a pick-up roller 3*b,* a pair of feeding rollers 3*c,* 3*d,* and a pair of registration rollers, in timed relation with the formation of the toner image. In the transfer position, there is provided a transfer roller 4 (transferring means), which functions to transfer the toner image onto the recording material 2 from the photosensitive drum 7 by being supplied with a voltage.

The recording material 2 now having the toner image transferred thereonto is fed to fixing means 5 along a feeding guide 3*f.* The fixing means 5 includes driving roller 5*c* and a fixing roller 5*b* containing therein a heater 5*a* to apply pressure and heat to the recording material 2 passing therethrough to fix the toner image on the recording material 2.

The recording material is then fed by pairs of discharging rollers 3*g,* 3*h,* 3*i* and is discharged to a discharging tray 6 along a reverse path 3*j.* The discharging tray 6 is disposed on the top surface of the main assembly 14 of the electrophotographic image forming apparatus in the form of a laser beam printer A. A deflectable flapper 3*k* is usable to discharge the recording material 2 by a pair of discharging rollers without using the reversing passage 3*j.* In this embodiment, the discharging rollers 3*g,* 3*h,* 3*i,* the pair of feeding rollers 3*c,* 3*d,* the pair of registration rollers, the feeding guide 3*f,* the pair of discharging rollers and the pair of discharging rollers 3*m,* constitute sheet feeding means.

The photosensitive drum 7 after the transfer roller 4 transfers the toner image onto the recording material 2, is cleaned by cleaning means 10 so that developer remaining on the photosensitive drum 7 is removed so as to be prepared for the next image-forming-process operation. The cleaning means 10 scrapes the remaining developer off the photosensitive drum 7 by an elastic cleaning blade provided contacting the photosensitive drum 7, and collects it to a residual developer container 10*b.*

In this embodiment, a process cartridge B includes a developing unit comprising a developer frame 11 including the developer-container developer 11A accommodating the developer and the developer-feeding member 9*b,* and a developing-device frame 12 supporting the developing means 9, such as the developing roller 9*a* and the developing blade 9*d,* and the process cartridge B further includes a cleaning frame 13 supporting the photosensitive drum 7, the cleaning means 10 such as the cleaning blade 10*a,* and the charging roller 8.

Figure 4:
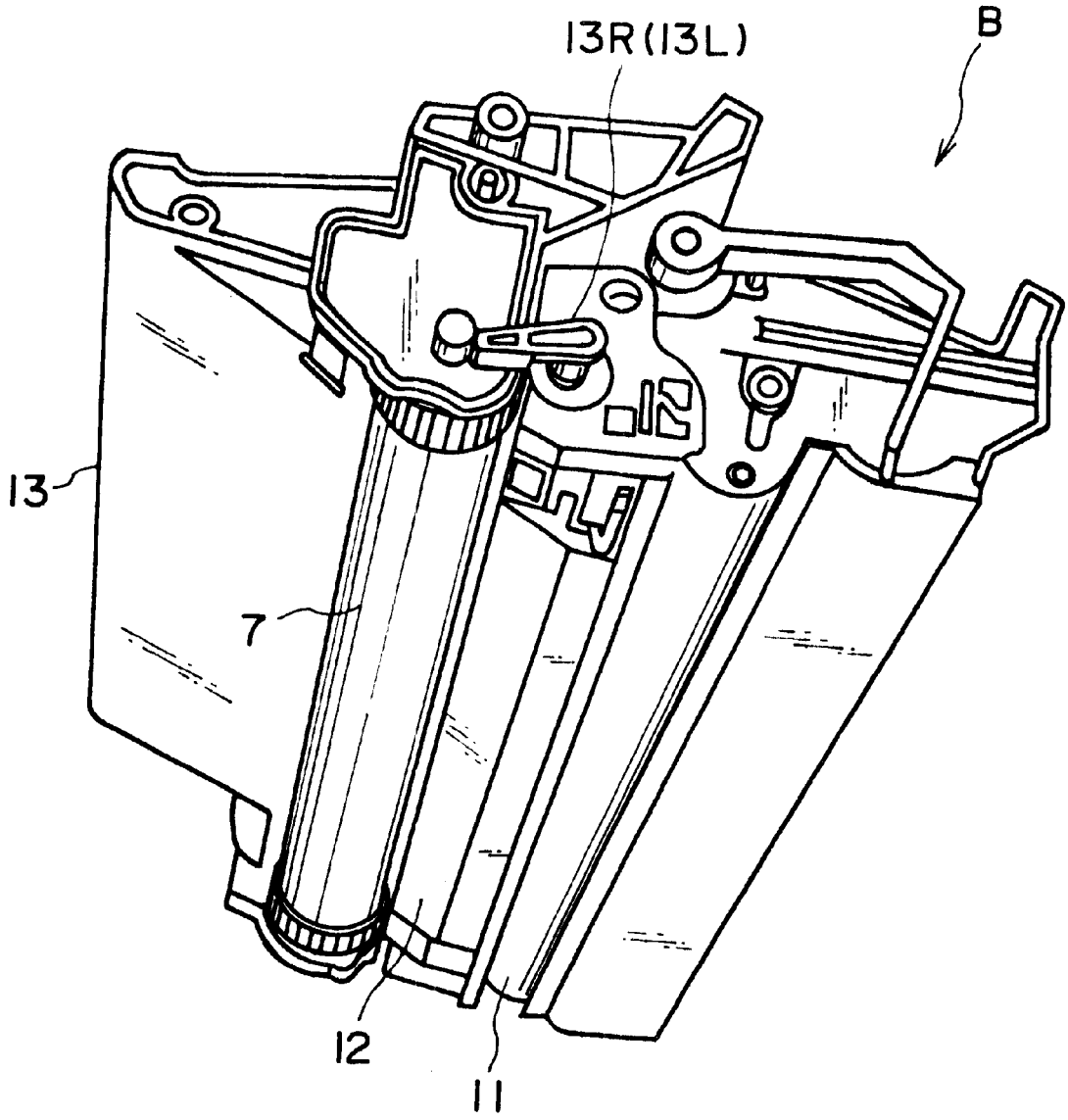
FIG. 4 is a perspective view of the outer appearance of a process cartridge according to an embodiment of the present invention, as seen from the bottom.
Figure 5:
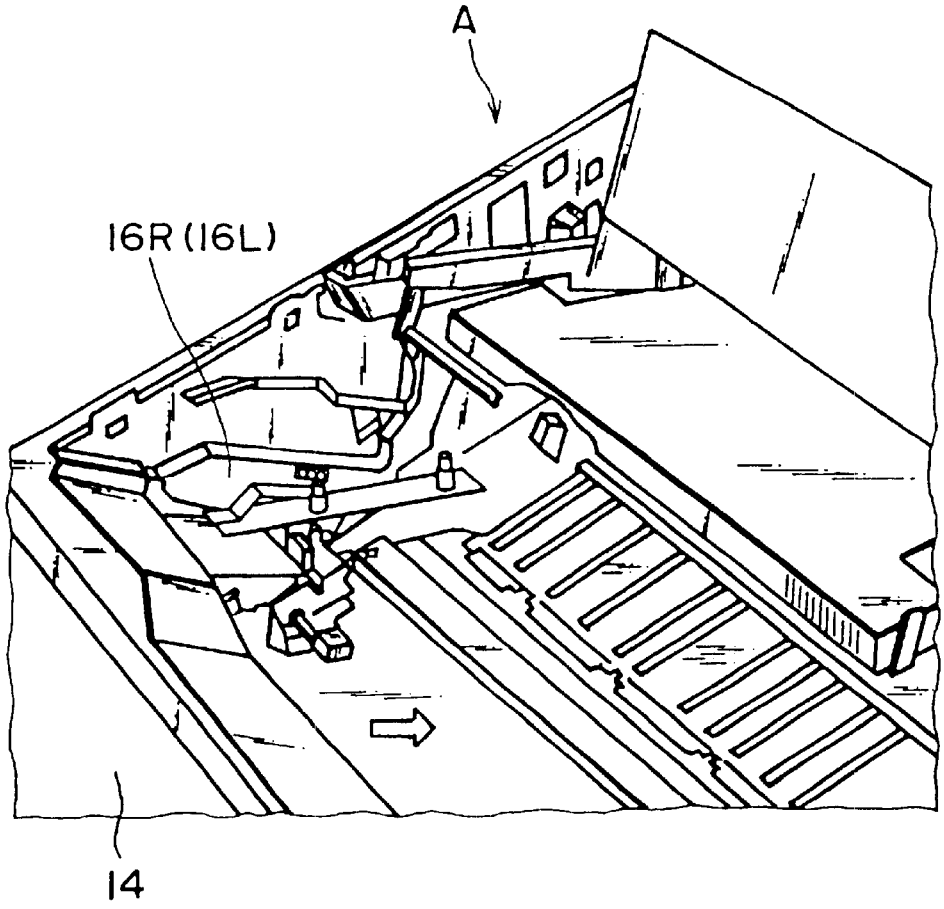
FIG. 5 is the perspective view of the outer appearance illustrating a mounting portion of a main assembly of an apparatus for mounting a process cartridge.

The process cartridge B is detachably mounted to the cartridge mounting means in the main assembly 14 of the electrophotographic image forming apparatus. In this embodiment, the cartridge mounting means comprises guide means 13R (13L) on the outer surface of the process cartridge B and guide portions 16R (16L) of the main assembly 14 of the apparatus for guiding the guide means 13R (13L), as shown in FIGS. 4 and 5.

According to the embodiment of the present invention, the process cartridge B is provided with a developer-amount detecting device for detecting substantially in real-time the remaining amount of the developer when the developer in the developer container 11A is consumed.

Figure 6:
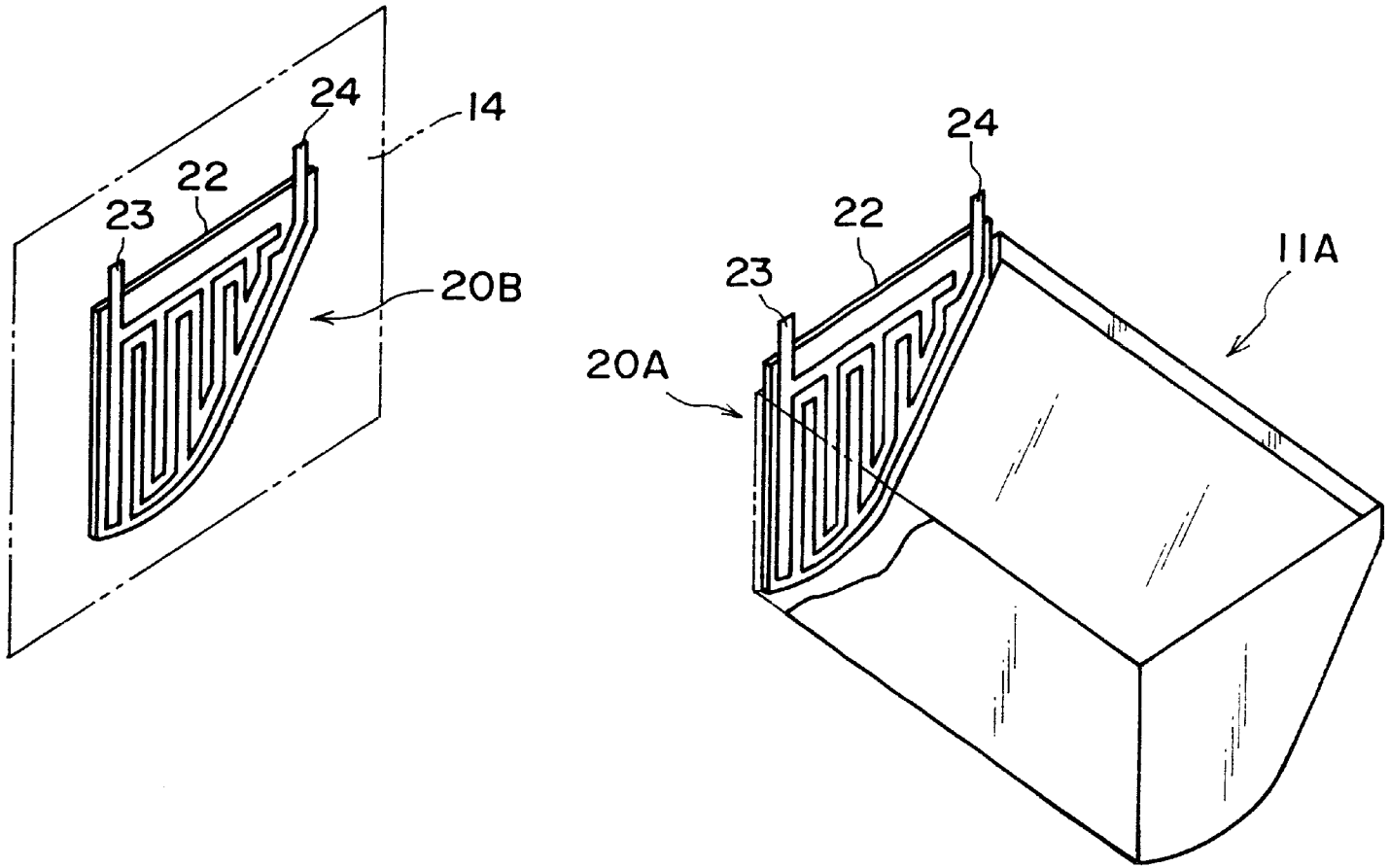
FIG. 6 is a perspective view of a developer container according to one embodiment of the present invention provided with a detecting device for detecting an amount of a developer.

As shown in FIG. 6, the developer-amount detecting device comprises a measuring electrode member 20A, which is a first electrostatic-capacity generating portion for detecting the amount of the developer, and a reference electrode member 20B, which is a second electrostatic-capacity generating portion for generating a reference signal on the basis of the detection of the ambient temperature and humidity.

Figure 7:
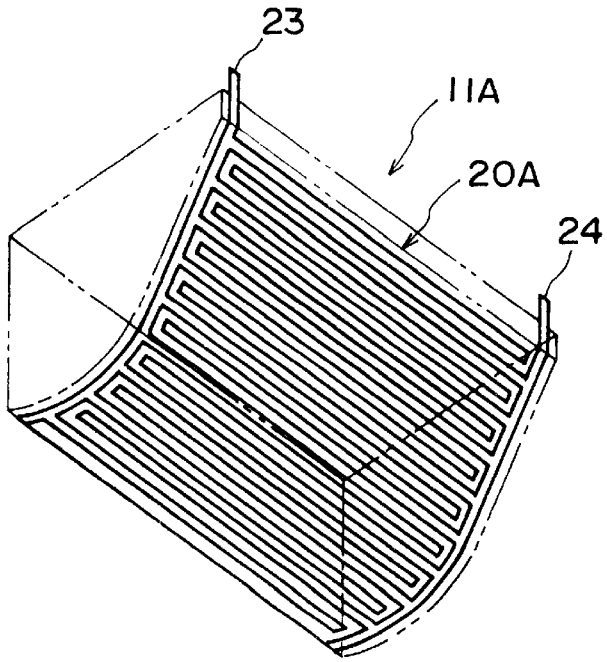
FIG. 7 is a perspective view of a developer container provided with a detecting device for detecting the amount of the developer according to an embodiment of the present invention.
Figure 9:
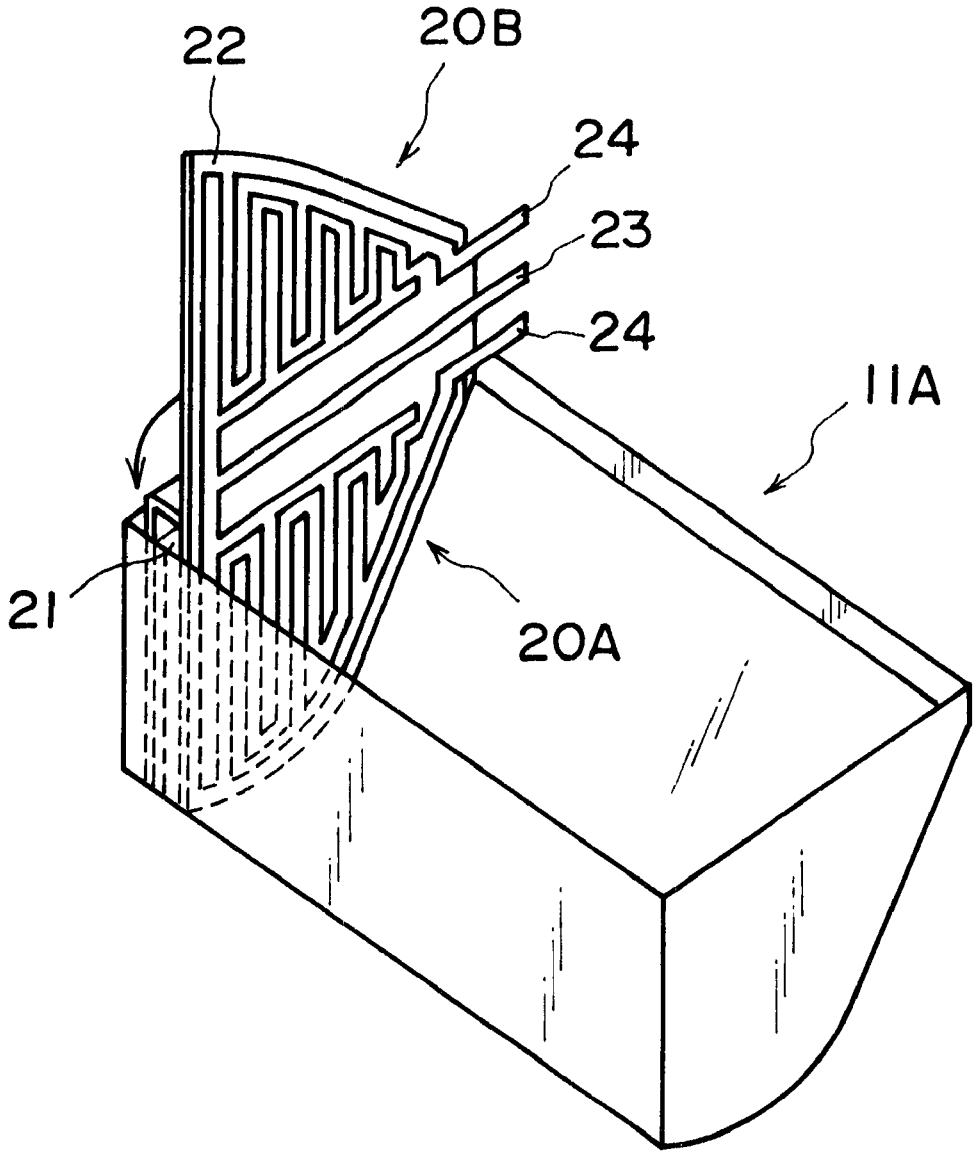
FIG. 9 is a perspective view of a developer container provided with a detecting device for detecting an amount of the developer according to an embodiment of the present invention.

The measuring-electrode member 20A is provided on an inside surface of the developer container 11A of the developing means 9 as shown in FIG. 6, or on such a portion in the developer container 11A that it is contacts the developer and that contact area thereof with the developer changes with a reduction of the developer, such as a bottom portion, as shown in FIG. 7. As shown in FIG. 6, the reference-electrode member 20B may be provided at any position of the main assembly 14 of the apparatus if it does not contact the developer, but the reference electrode member 20B may be disposed in the developer container 11A at such position as is opposite from the measuring-electrode member 20A and is separated by a partition wall 21 so as not to be in contact with the developer. Alternatively, as shown in FIG. 9, the measuring-electrode member 20A and the reference-electrode member 20B may be integrally manufactured so as to have a symmetric structure, and in this case, the reference-electrode member 20B may be bent outwardly to the opposite side of the partition wall 21 (the side not contacting the developer) at the same side as the measuring-electrode member 20A.

Figure 10:
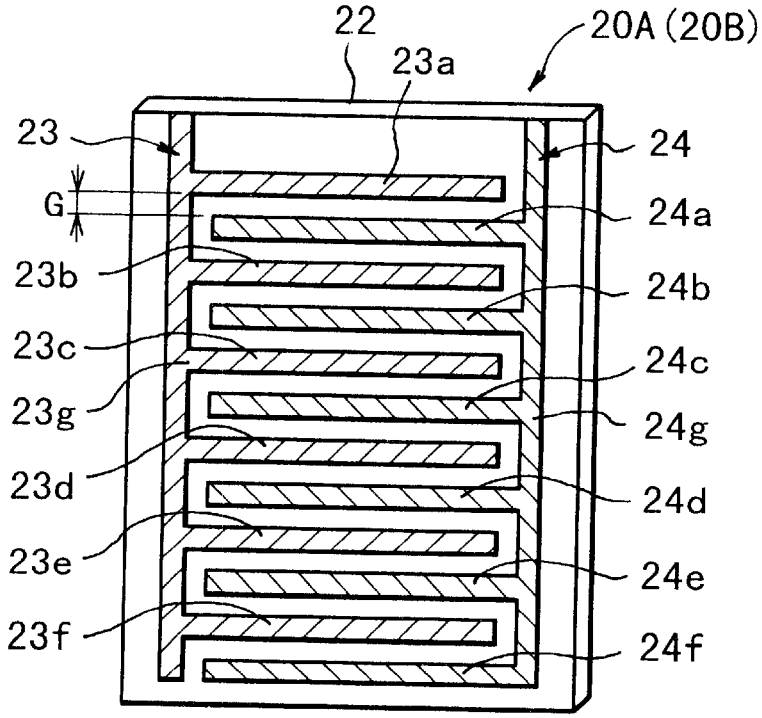
FIG. 10 is a front view of a measuring electrode member and a reference electrode member according to an embodiment of the present invention.
Figure 11:
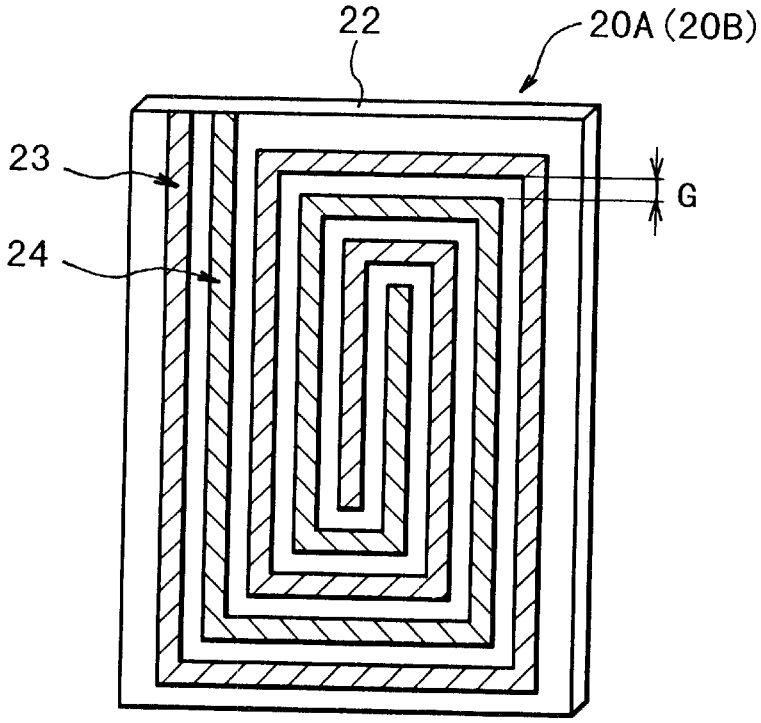
FIG. 11 is a front view of a measuring electrode member and a reference electrode member according to another embodiment of the present invention.

As shown in FIG. 10, the measuring-electrode member 20A comprises a pair of electroconductive portions (electrodes 23, 24) that are extended in parallel with each other with a predetermined gap on the substrate 22. Each of the electrodes 23, 24 may have a base portion and a plurality of branch portions extended from the base portion, and the branch portions may be in parallel with a predetermined gap between adjacent ones alternately, that is, in an interlaced fashion. In this embodiment, the electrodes 23, 24 have at least one pair of electrode portions 23*a*–23*f*, 24*a*–24*f* juxtaposed in parallel with a predetermined gap G, and the electrode portions 23*a*–23*f*, 24*a*–24*f* are connected to the connecting electrode portions 23*g*, 24*g*, respectively. Thus, the two electrodes 23 and 24 have a comb-like configuration with the branch portions interlaced with each other. However, the electrode pattern of the measuring-electrode member is not limited to those examples, and for example, as shown in FIG. 11, the electrodes 23, 24 may be extended in a volute pattern with constant gap.

The measuring-electrode member 20A detects the remaining amount of the developer (the developer remainder) in the developer container 11A by detecting the electrostatic capacity between the parallel electrodes 23, 24. Since the developer has a dielectric constant that is larger than that of the air, the contact of the developer on the surface of the measuring-electrode member 20A increases the electrostatic capacity between the electrodes 23, 24.

Therefore, according to this embodiment, the measuring-electrode member 20A can detect the developer in the developer container 11A on the basis of the area of the developer contacting the surface of the measuring electrode member 20A, using a predetermined calibration curve, irrespective of the cross-sectional configuration of the developer container 11A or the configuration of the measuring-electrode member 20A.

The electrode patterns 23, 24 of the measuring electrode member 20A can be provided by, for example, forming electroconductive metal patterns 23, 24 of copper or the like through etching or printing on a hard print board 22 such as paper phenol, glass epoxy resin or the like having a thickness of 0.4–1.6 mm or on a flexible printed board 22 of polyester, polyimide or the like resin material having a thickness of 0.1 mm. That is, they can be manufactured through the same manufacturing method as with ordinary printed boards and wiring patterns. Therefore, the complicated electrode pattern as shown in FIGS. 10 and 11 can be easily manufactured at the same cost as with simple patterns.

When a complicated pattern shown in FIG. 10 or 11 is used, the length along which the electrodes 23, 24 are opposed to each other can be increased, and in addition, by using a pattern-forming method such as etching, the gap between the electrodes 23, 24 can be reduced to several tens $\mu$m approximately, so that a large electrostatic capacity can be provided. The detection can be enhanced by increasing the amount of change of the electrostatic capacity. More particularly, the electrodes 23, 24 have a width of 0.1–0.5 mm, and a thickness of 17.5–70 $\mu$m with the gap G therebetween of 0.1–0.5 mm. The surface on which the metal pattern is formed can be laminated with thin resin film having a thickness of 12.5–125 $\mu$m for example.

As described in the foregoing, according to the detecting device for the amount of the developer according to the present invention, the measuring electrode member 20A is disposed on the inner surface of the developer container 11A or on such an inner bottom surface that the contact area with a developer reduces with consumption of the developer, and the total amount of the developer in the developer container can be detected by the change of the electrostatic capacity of the measuring-electrode member 20A, which change is indicative of the change of the contact area with the developer.

Since the dielectric constant of the developer is larger than that of the air, the electrostatic capacity is larger at the portion where the developer contacts the measuring-electrode member 20A (where the developer exists) than at the portion where no developer is contacted thereto (where the developer does not exist). Therefore, the amount of the developer in the developer container 11A can be detected by detecting the change of the electrostatic capacity.

Figure 12:
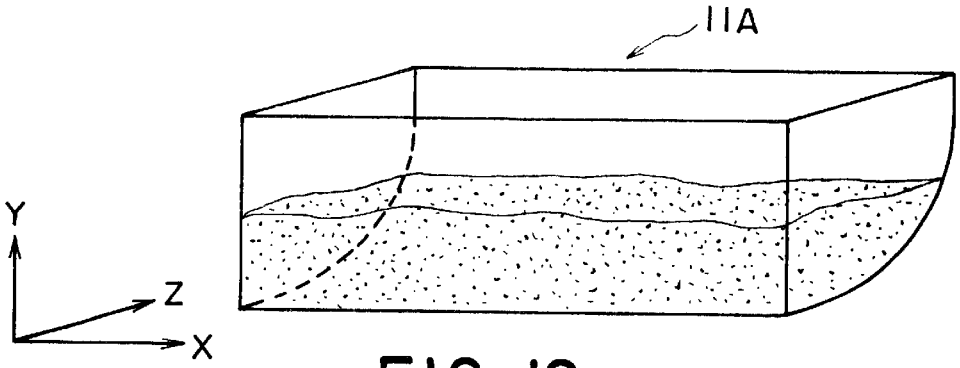
FIG. 12 is an illustration of the accommodation of a developer in a developer container.
Figure 13:
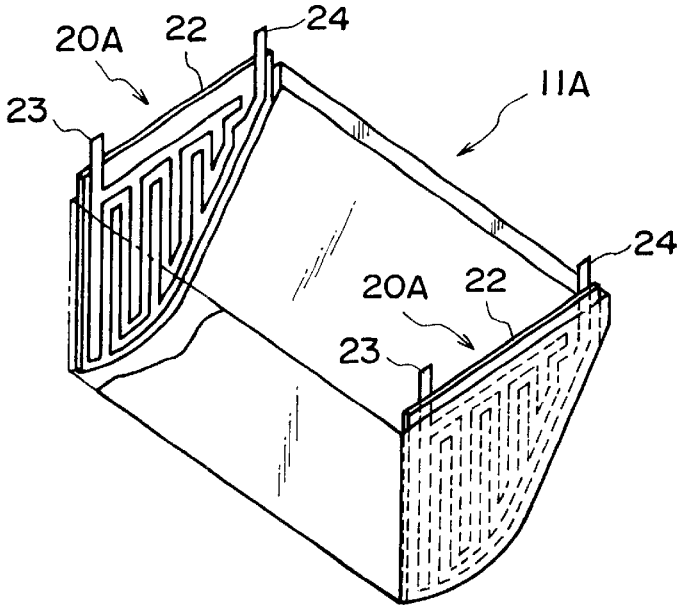
FIG. 13 is a perspective view of a developing means provided with a detecting device for detecting an amount of a developer according to one embodiment of the present invention.

As shown in FIG. 6, by disposing the measuring-electrode member 20A on one inner side of the developer container 11A, the percentage of the area contacting the developer to the cross-sectional area of the developer container in the YZ flat surface in FIG. 12, can be deduced or estimated from the detected electrostatic capacity.

Figure 14:
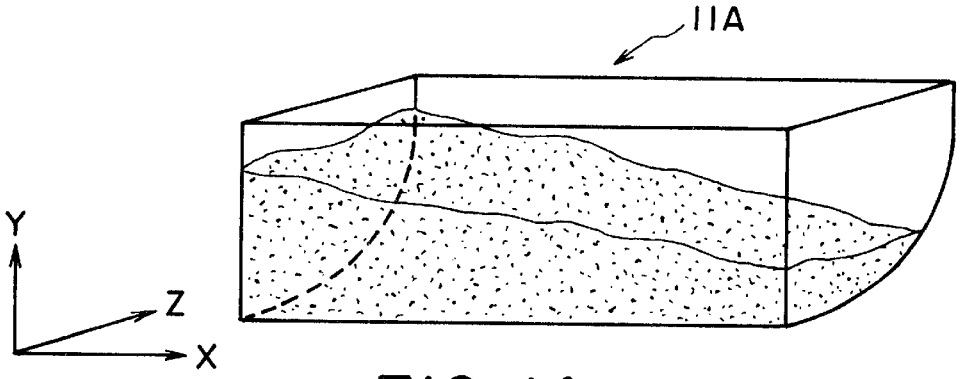
FIG. 14 is an illustration of accommodation of a developer in the developer container.

As shown in FIG. 14, the developer may exist unevenly along the longitudinal direction due to the demounting and mounting of the process cartridge for jam clearance, for example, due to the inclination of the process cartridge or due to an uneven printing pattern, as shown in FIG. 14. By providing the measuring-electrode member 20A at each inner longitudinal end of the developer container, the uneven distribution of the developer can be detected on the basis of the outputs of the two electrode members 20A, 20A, so that the correct detection of the developer remainder is accomplished.

As shown in FIG. 7, when the measuring electrode member 20A is disposed on the inner bottom surface of the developer container 11A, the percentage of the contact area occupying the bottom area can be estimated so that the influence of the uneven distribution of the developer in the longitudinal direction is minimized. Since the bottom area is larger than the end area in the developer container 11A, the area of the developer-amount detecting member 20A can be made larger than when the developer-amount detecting member 20A is disposed at the end of the developer container 11A, so that the amount of the change of the electrostatic capacity can be made larger, that is, the output of the detector can be made larger, and therefore, the measurement error can be minimized.

When the electrode members are provided on the inner bottom surface and the inner end surface or surfaces of the developer container 11A, the amount of the developer in the developer container 11A can be estimated in three dimensions, so that the amount of the developer can be more correctly detected.

According to this embodiment, the detecting device for the remaining amount of the developer comprises a reference-electrode member 20B what functions as a second electrostatic-capacity generating portion, as shown in FIG. 6.

The reference-electrode member 20B has a similar structure as the measurement electrode member 20A, and as shown in FIG. 10, it comprises a pair of electroconductive portions, namely, electrodes 23(23*a*–23*f*), 24 (24*a*–24*f*) which are disposed in parallel with a predetermined gap on a substrate 22. The branch portions of the electrodes 23 and 24 are interlaced, or the volute patterns shown in FIG. 11 are also usable. The reference-electrode member 20B can be manufactured through the same manufacturing process as with the printed boards and the wiring patterns.

According to this embodiment, the electrostatic capacity of the reference-electrode member 20B changes in accordance with the ambient condition such as the temperature and the humidity as described hereinbefore, so that it functions as a calibration member (reference electrode or member) for the measuring-electrode member 20A.

Thus, according to the detecting device for the amount of the developer of this embodiment, the output of the measuring-electrode member 20A is compared with the output of the reference-electrode member 20B, which is indicative of the change of ambient conditions. For example, the electrostatic capacity of the reference-electrode member 20B in a predetermined state is set to be the same as the electrostatic capacity of the measuring-electrode member 20A when no developer exists, and then, the difference of the outputs of the reference-electrode member 20B and the measuring-electrode member 20A is indicative of the change of the electrostatic capacity caused by the presence of the developer, so that the accuracy of the detection of the remaining amount of the developer can be enhanced.

A description will be provided in more detail as to the detection principle of the amount of the developer. The measuring-electrode member 20A detects the electrostatic capacity of the contact portion of the surface of the pattern to estimate the amount of the developer in the developer container 11A, and therefore, the output is influenced by the change of the ambiance (humidity, temperature or the like).

For example, when the humidity is high, which means that the content of the moisture in the air is high, the dielectric constant of the atmospheric air contacting the detecting member 20A is high. Therefore, even when the amount of the developer is the same, the output of the measuring-electrode member 20A changes if the ambient condition changes. Additionally, if the material of the substrate 22 constituting the pattern absorbs moisture, the dielectric constant changes with the result, in effect, of the ambient conditions change.

By the use of the reference-electrode member 20B, as the calibration element, which exhibits the same change as the measuring-electrode member 20A in accordance with the ambient condition change, that is by the use of the reference-electrode member 20B having the same structure as the measuring-electrode member 20A but not contacting the developer, the reference electrode-member 20B being placed under the same condition as the measuring-electrode member 20A, the developer remainder can be detected without the influence of the ambient condition variation when the difference of the outputs of the measuring-electrode member 20A and the reference-electrode member 20B are used for the detection.

Figure 15:
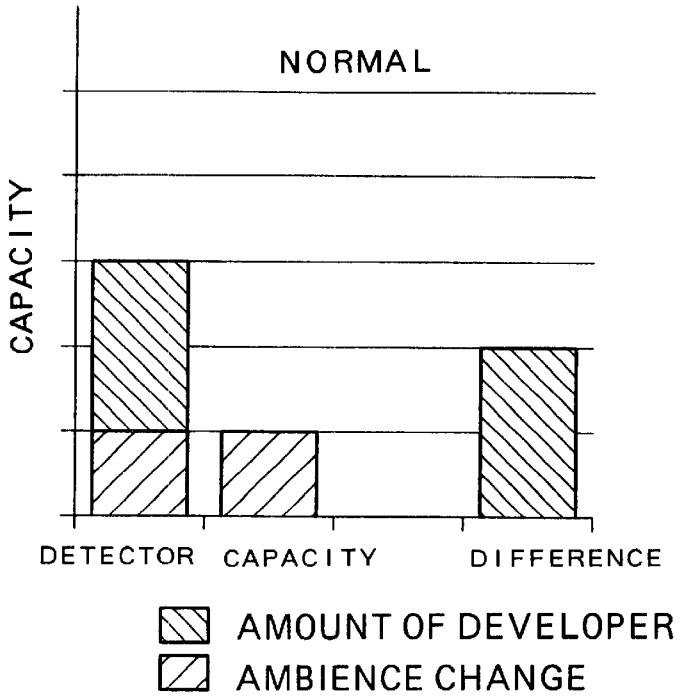
FIG. 15 is a graph explaining a detection principle for the amount of the developer according to an embodiment of the present invention.

As shown in the bar graph of FIG. 15, at the leftmost part, the electrostatic capacity is determined by the measuring-electrode member 20A for detecting the amount of the developer, which is indicative of the variation of the developer contacting the surface of the detecting member plus the variation of the ambient condition. If the same situation is placed under a high temperature and high humidity ambience, the electrostatic capacity increases despite the fact that the amount of the developer is the same, since the electrostatic capacity increases corresponding to the ambient condition change, as indicated at the leftmost part in FIG. 16.

Figure 16:
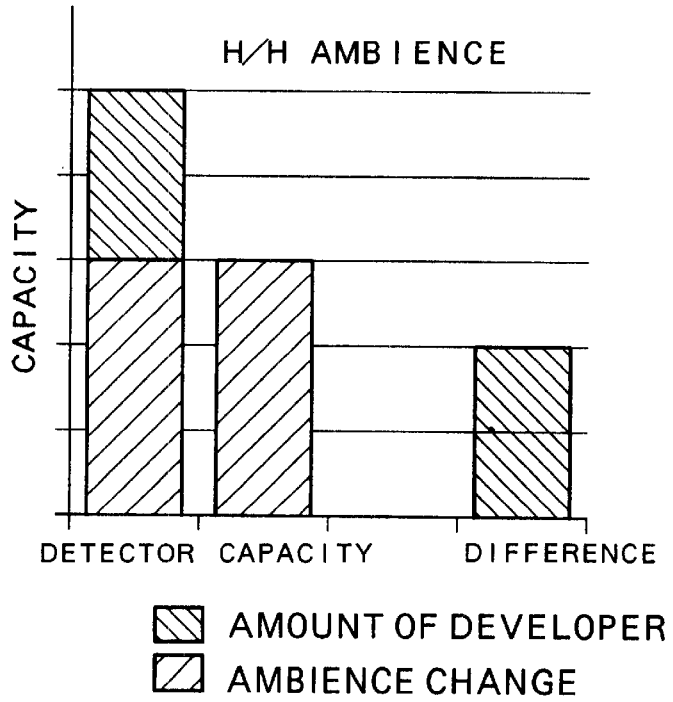
FIG. 16 is a graph explaining a detection principle for an amount of the developer according to an embodiment of the present invention.

As shown in the middle parts of FIGS. 15 and 16, the reference-electrode member (calibration electrode) 20B exhibiting the same response to the ambient condition variation as the measuring-electrode member (detecting member) 20A, is used, and the difference therebetween (right side of the graph) is taken, by which the electrostatic capacity indicative of the amount of the developer only, can be provided.

Figure 17:
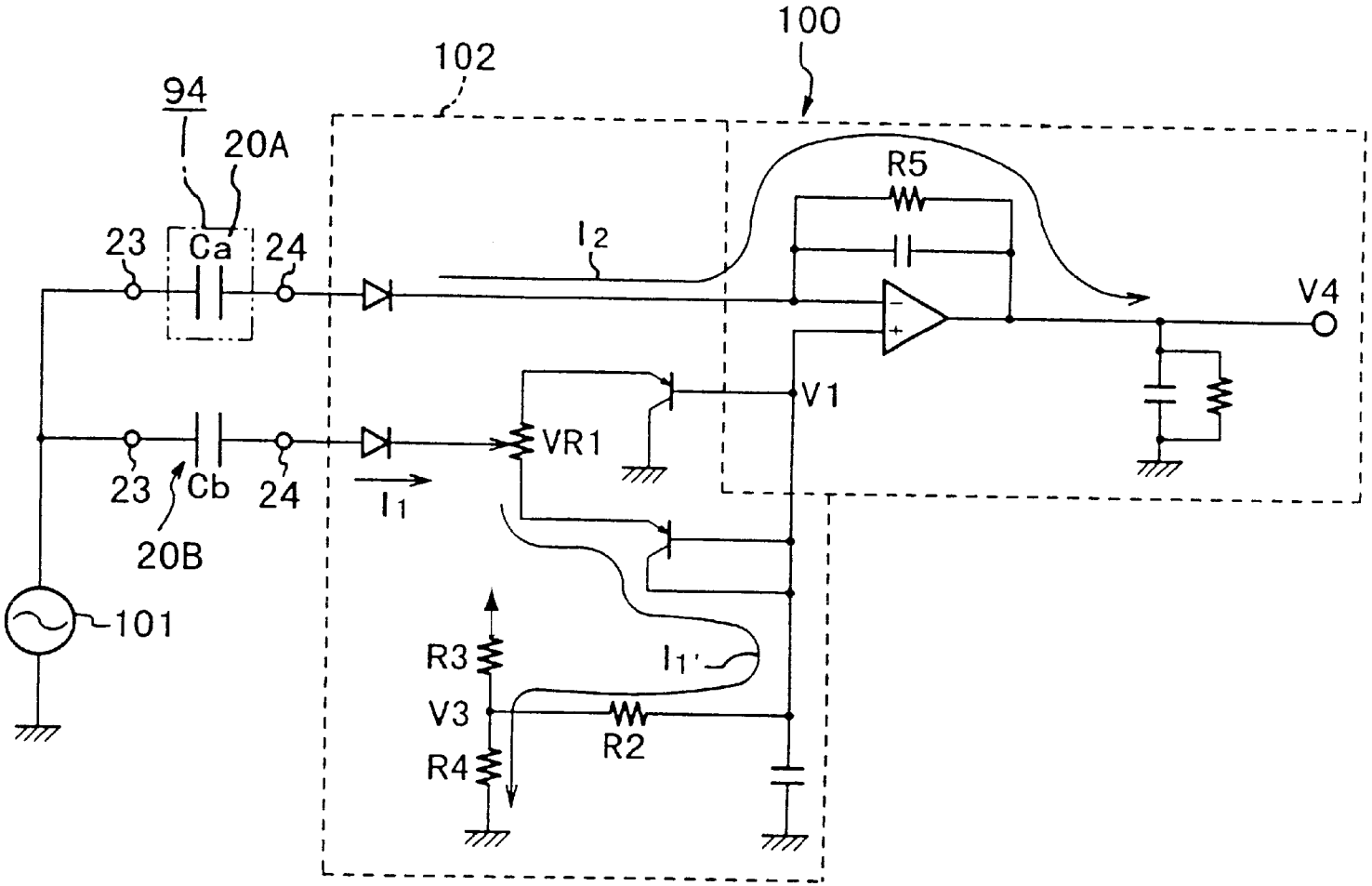
FIG. 17 shows a detecting circuit for an amount of the developer for detecting device for the amount of the developer according to an embodiment of the present invention.

Referring to FIG. 17, the detecting device for the amount of the developer embodying the above described principle will be described. FIG. 17 shows an example of a circuit for developer detection, more particularly, the figure shows the connection between the measuring-electrode member 20A and the reference-electrode member 20B in the image forming apparatus.

The measuring-electrode member 20A, as the detecting member having an electrostatic capacity Ca that changes in accordance with the amount of the developer, and the reference-electrode member 20B, as a calibration electrode having an electrostatic capacity Cb that changes in accordance with the ambient condition, are connected as indicated; more particularly, one of the electrodes 23 is connected to the developing-bias circuit 101 (developing bias applying means), and the other is connected to the control circuit 102 of developer-amount detecting circuit 100. The reference-electrode member 20B uses an AC (alternating) current $I_1$ supplied through a developing-bias circuit 101, and a reference voltage V1 for detecting the developer remainder is set.

The control circuit 102, as shown in FIG. 17, adds, to the voltage V3 set by the resistances R3, R4, the voltage drop V2 determined by the resistance R2 and the AC current $I_1'$, which is the current branched by a volume VR1 from the AC current $I_1$ supplied to the reference electrode member 20B, that is, an impedance element.

The AC (alternating) current $I_2$ applied to the measuring-electrode member 20A is inputted to the amplifier, and is outputted as the detected value V4 ($V1-I_2 \times R5$) indicative of the developer remainder. The voltage output is the detected value indicative of the developer remainder.

As described in the foregoing, according to the developer-amount detecting device of this embodiment, use is made of the reference-electrode member 20B (calibration element) exhibiting the same capacity change in accordance with the ambient-condition change as the measuring-electrode member 20A, so that detection error, due to a variation of the ambient condition, can be canceled or compensated for so that high accuracy in the detection for the developer remainder can be accomplished.

According to this embodiment, the reference-electrode member 20B as the calibration member may have another structure and can be disposed at another place.

Figure 18:
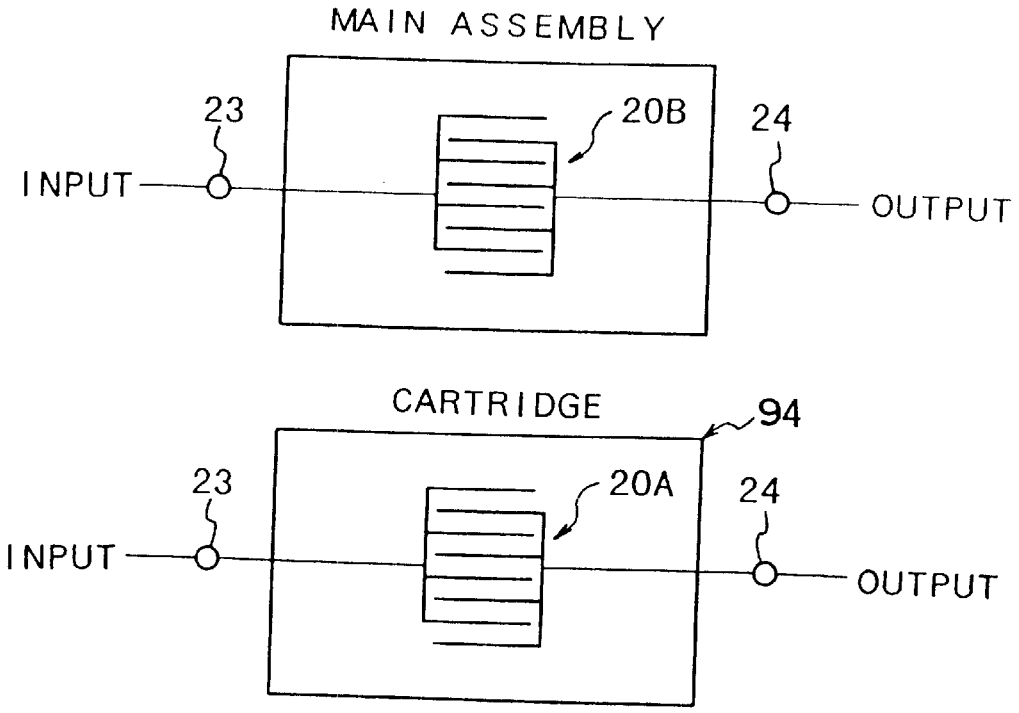
FIG. 18 shows arrangements of a measuring electrode member and a reference electrode member according to one embodiment of the present invention.

For example, as shown in FIGS. 6 and 18, he reference-electrode member 20B having the same structure as the measuring-electrode member 20A may be placed in the main assembly of the image forming apparatus. With this structure, the electrostatic capacity of the reference-electrode member 20B changes in the same manner as the measuring-electrode member 20A in accordance with the change of the ambiance, so that the output of the changes attributable to the ambience variation can be canceled from the output of the measuring-electrode member 20A.

Figure 8:
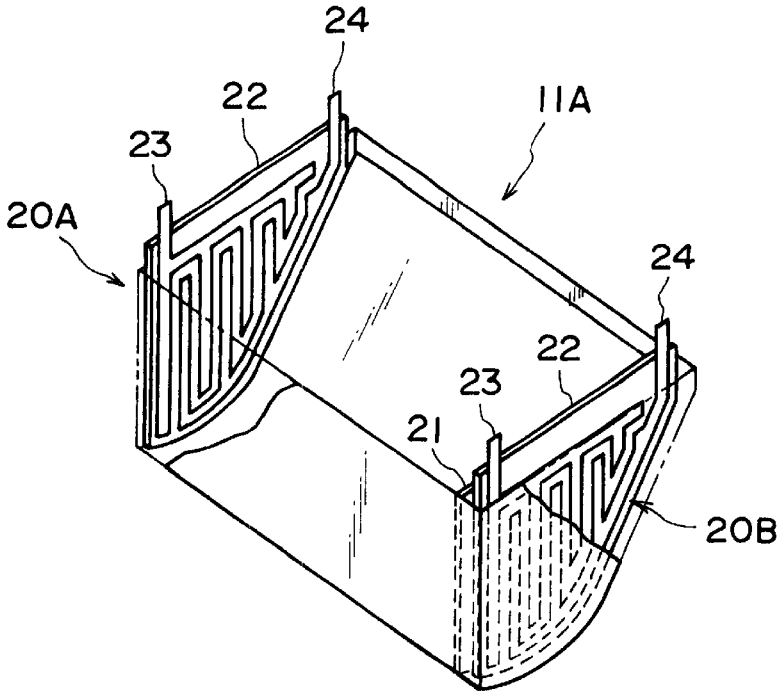
FIG. 8 is a perspective view of a developer container provided with a detecting device for detecting an amount of the developer according to an embodiment of the present invention.
Figure 19:
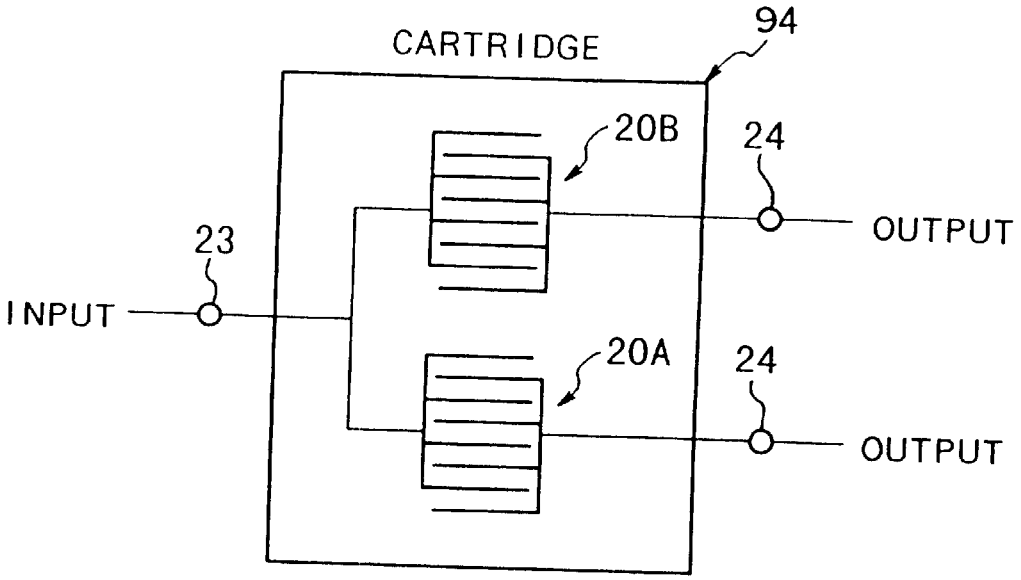
FIG. 19 shows arrangements of a measuring electrode member and a reference electrode member according to one embodiment of the present invention.

As shown in FIGS. 8, 9 and 19, the measuring-electrode member 20A and the reference-electrode member 20B having the same structure as the measuring-electrode member can be placed in the developer container 11A of the developing means 94. In this case, since the measuring-electrode member 20A and the reference-electrode member 20B for calibration are provided in the developer container, the variation due to the ambience change can be canceled, and since the measurement electrode member (detecting member) 20A and the reference-electrode member (calibration member) 20B are placed in the same ambient conditions, the detection accuracy can be enhanced.

In the description of the foregoing embodiment, the electrode patterns 23, 24 of the reference electrode member 20B have substantially the same electrostatic capacities, and substantially the same pattern widths, lengths, clearances and opposing areas. In such a case, the pattern design is easy, and the variations resulting from the differences in the electrostatic capacity among the products and the differences in the ambient conditions, can be minimized.

In addition, it is possible that area of the electrode patterns 23, 24 of the reference-electrode member 20B for calibration is different from the area of the electrode patterns 23, 24 of the measuring-electrode member 20A. In this case, the output of the reference-electrode member 20B is multiplied by a predetermined coefficient, and the multiplied output is compared with the output of the measuring-electrode member 20A. Using such a structure, the size of the reference-electrode member 20B can be reduced so that the space occupied by the detecting member can be reduced. The members 20A and 20B may be placed on the same wall of the developer container 11A at the same side, and the reference-electrode member 20B is prohibited from contacting to the developer, and in this case, it is possible to increase the percentage of the pattern area of the detecting member 20A in the limited the area, and therefore, the amount of the change of the electrostatic capacity and the detection accuracy can be enhanced.

In the foregoing, the same configurations or same dimensions do not mean exactly identical configuration or dimensions, and do not exclude those having a difference due to manufacturing errors or the like as long as the intended detection can be made with practical accuracy.

Figure 3:
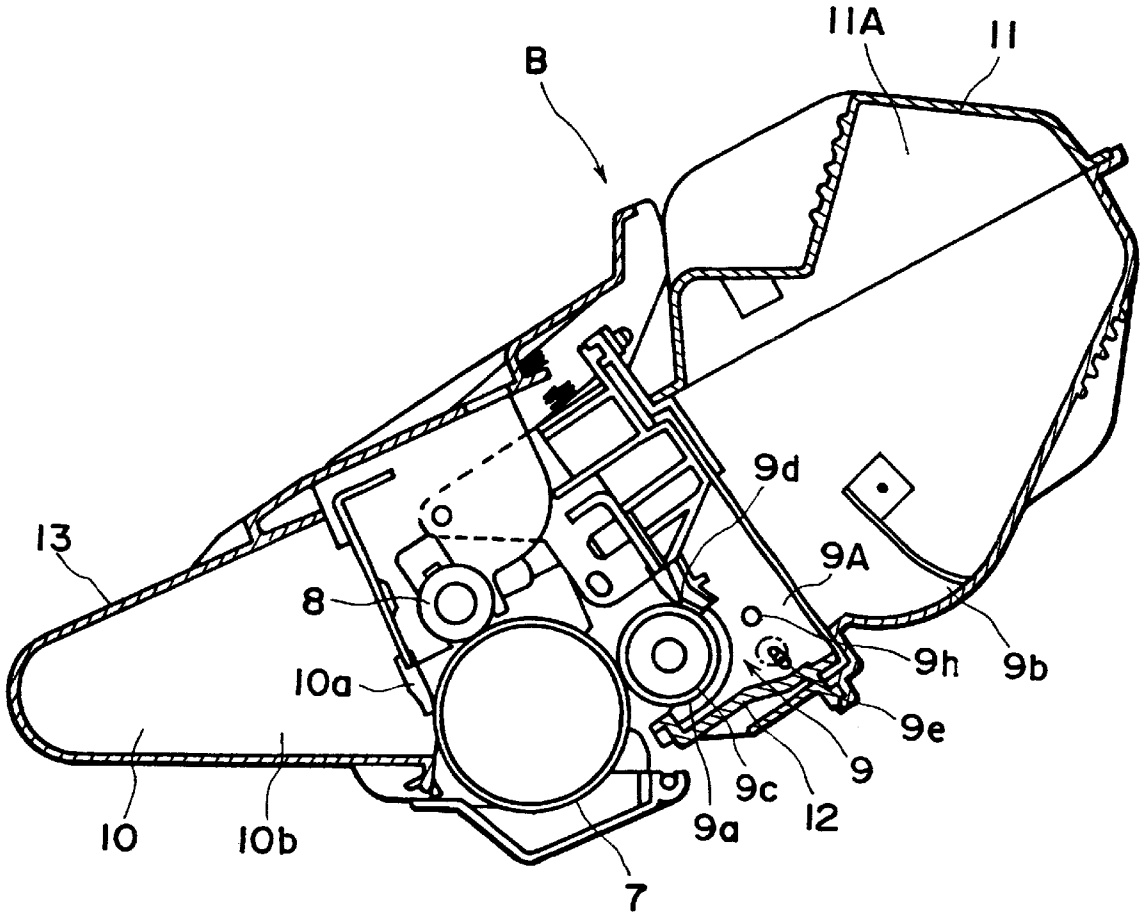
FIG. 3 is a longitudinal sectional view of a process cartridge according to an embodiment of the present invention.

As described in the foregoing, according to this embodiment, the developer container 11A is provided with the measuring-electrode member 20A and the reference-electrode member 20B for substantially real-time detection of the developer remainder, further preferably, the developer chamber 9A of the developing means 9 is provided with an antenna rod, that is, an electrode rod 9*h* FIG. 3 is extended by a predetermined length in the longitudinal direction of the developing roller 9*a* with a predetermined clearance from the developing roller 9*a*. With this structure, the emptiness of the developer in the developer container can be detected by detecting the change of the electrostatic capacity between the developing roller 9*a* and the electrode rod 9*h*.

According to the image forming apparatus of this embodiment, the amount of the developer in the developer container 11A can be detected substantially in real-time, and on the basis of the detection, the consumption amount of the developer may be displayed so as to influence the user to prepare the replenishing cartridge and further to supply the developer upon the display of the emptiness.

Figure 20:
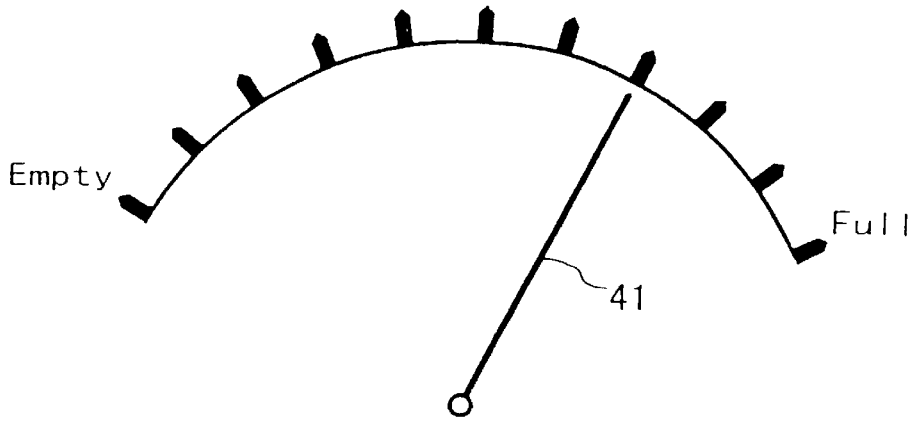
FIG. 20 is an illustration of the display of an amount of the developer according to an embodiment of the present dimension.
Figure 21:
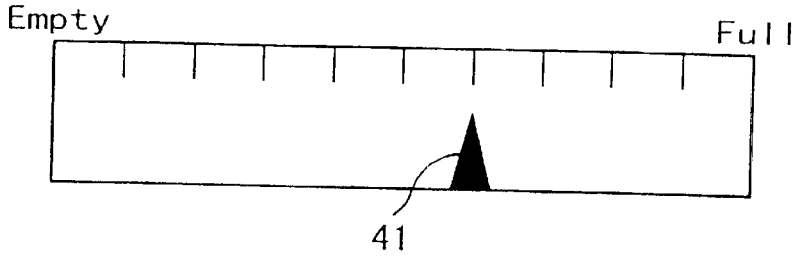
FIG. 21 shows another example of the display of an amount of the developer according to an embodiment of the present invention.

A description will be provided as to the manner of display of the amount of the developer. The detected information provided by the developer-amount detecting device is displayed on the screen of the terminal equipment, such as a personal computer of the user in the manner, shown in FIGS. 20 and 21. In FIGS. 20 and 21, an indicator 41 moves in accordance with the amount of the developer so that user is aware of the amount of the developer.

Figure 22:
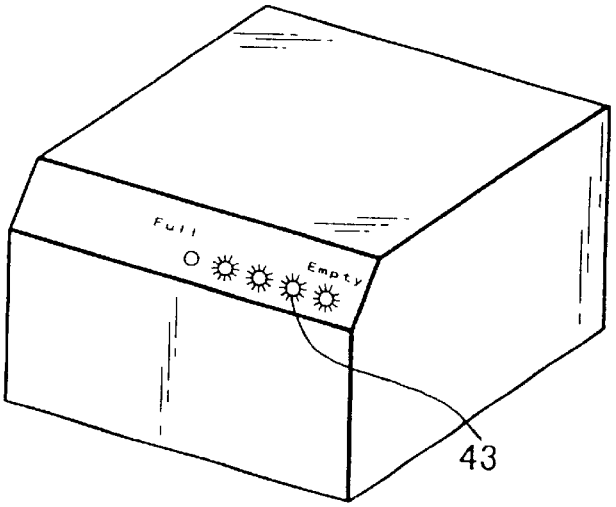
FIG. 22 shows a further example of the display of an amount of the developer according to an embodiment of the present invention.

FIG. 22 shows an alternative, wherein the main assembly of the electrophotographic image forming apparatus is provided with a display portion of, LED (43) or the like, which is lit on or off, in accordance with the amount of the developer.

(Embodiment 2)

Figure 23:
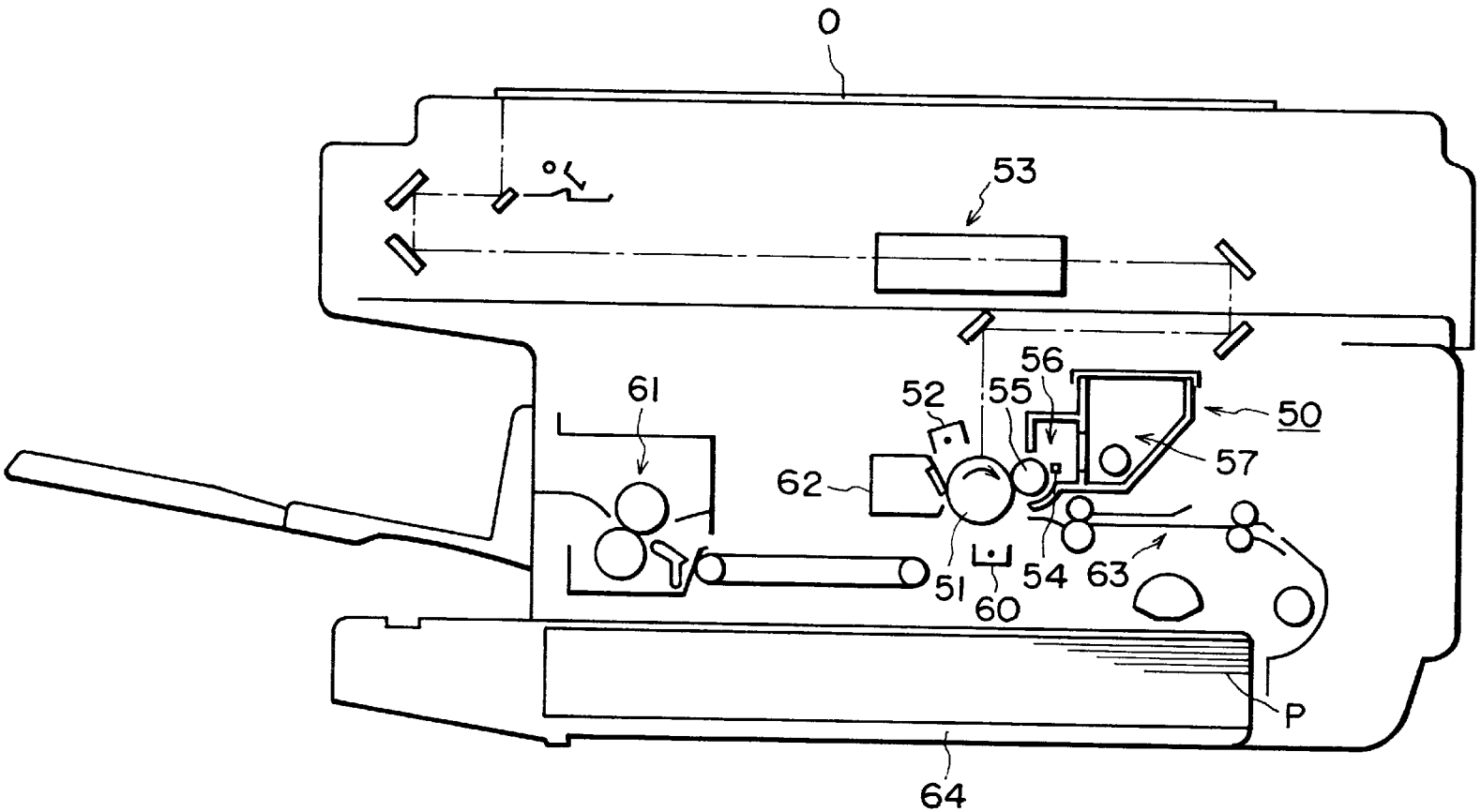
FIG. 23 is a schematic illustration of an electrophotographic image forming apparatus according to another embodiment of the present invention.

FIG. 23 is a schematic view of an electrophotographic image forming apparatus according to another embodiment of the present invention. The general arrangement of the electrophotographic image forming apparatus will first be described. In this embodiment, the electrophotographic image forming apparatus comprises an electrophotographic photosensitive drum 51 as an image bearing member, which rotates in the direction indicated by the arrow. The photosensitive drum 51 is uniformly charged by a charging device 52, and then, is subjected to image exposure of an original O through a projection optical system 53, so that an electrostatic latent image is formed on the photosensitive drum 51.

The electrostatic latent image on the photosensitive drum 51 is developed by a developing device 50 into a visualized image (toner image). The developing device 50 includes a developing zone 56 having a developing sleeve 55 (developer carrying member) and a developer accommodating portion 57 (developer accommodating container) for accommodating the developer. The developer in the developer accommodating portion 57 is supplied to a developing zone 56 and is carried on the developing sleeve 55 to a developing zone where the developing sleeve 55 is opposed to the photosensitive drum 51, so that the electrostatic latent image on the photosensitive drum 51 is developed. The developing sleeve 55 is electrically connected to the developing-bias circuit and is supplied with a developing-bias voltage, which is in the form of an AC voltage biased with DC voltage. The visualized image on the photosensitive drum 51, that is, the toner image is transferred by a transfer charging device 60 onto a transfer sheet P (recording material) fed from a transfer sheet accommodating portion 64 by feeding means 63. The toner image transferred onto the transfer sheet P is fixed on the transfer sheet P by a fixing device 61, and then the transfer sheet P is discharged to the outside of the apparatus. On the other hand, the developer or remaining on the photosensitive drum 51 is removed by a cleaning device 62 so that photosensitive drum 51 is prepared for the next image forming operation.

According to this embodiment, the electrophotographic image forming apparatus is provided with a developer-amount detecting device for detecting substantially in real-time the remaining amount in response to the consumption of the developer in the developer accommodating portion 57 (developer accommodating container) of the developing device 50.

Figure 24:
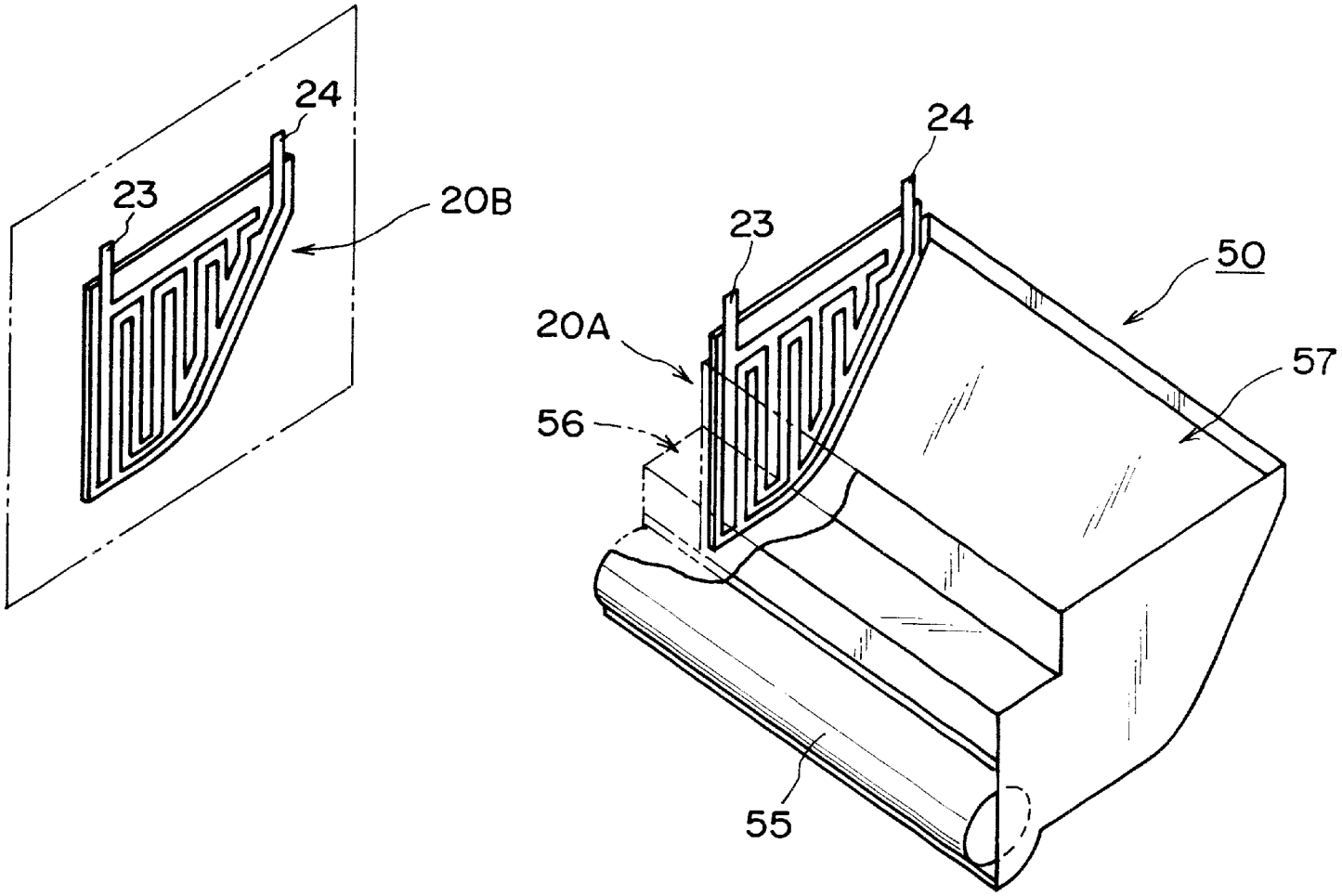
FIG. 24 is a perspective view of a developing device provided with a detecting device for detecting an amount of a developer according to an embodiment of the present invention.

The developer-amount detecting device has the same structure and that described with Embodiment 1. As shown in FIG. 24, it comprises a measuring-electrode member 20A as a first electrostatic-capacity generating portion for detecting an amount of the developer, and a reference-electrode member 20B as a second electrostatic-capacity generating portion (calibration electrode) for outputting a reference signal, which is generated on the basis of the detected ambience, that is, the temperature and the humidity of the ambience.

Figure 25:
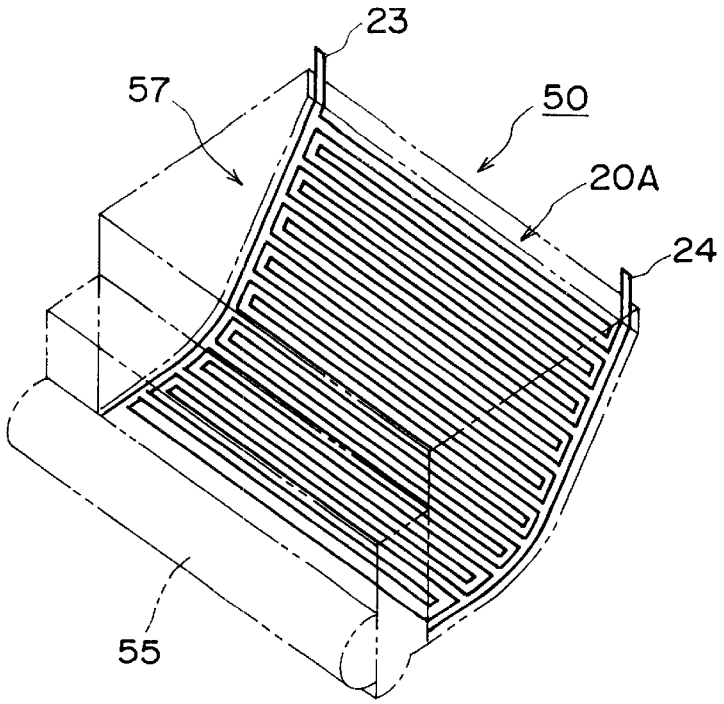
FIG. 25 is a perspective view of a developing device provided with a detecting device for detecting an amount of a developer according to a further embodiment of the present dimension.
Figure 26:
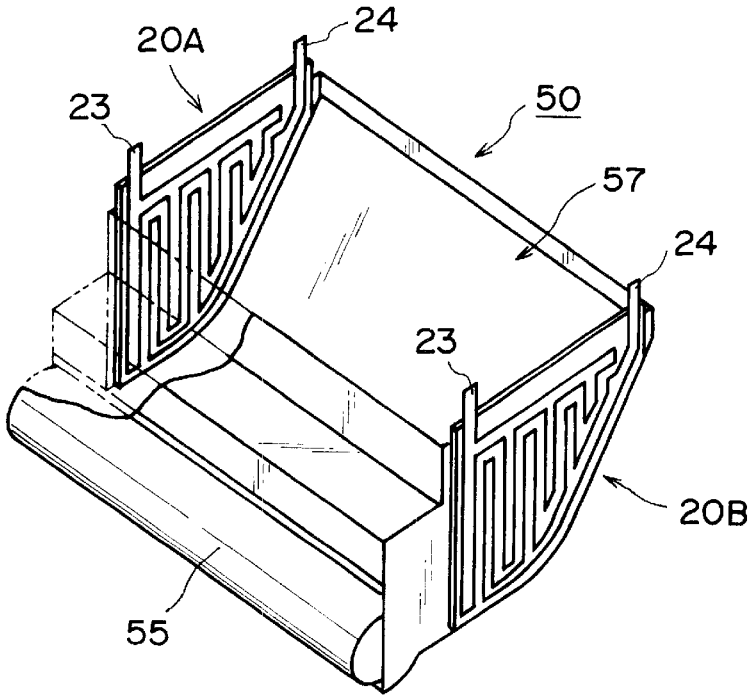
FIG. 26 is a perspective view of a developing device provided with a detecting device for detecting an amount of the developer according to a further embodiment of the present invention.
Figure 27:
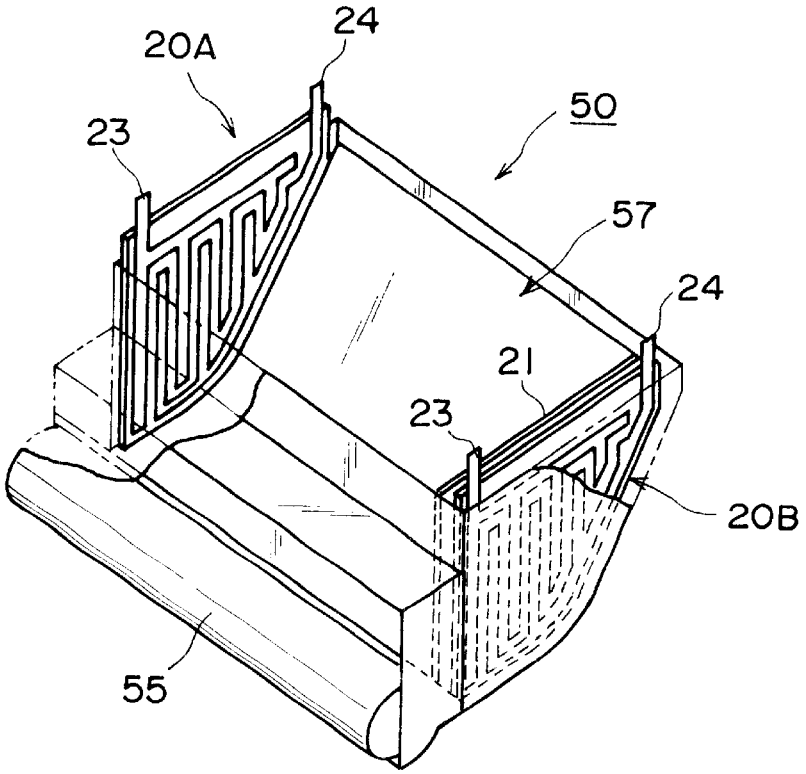
FIG. 27 is a perspective view of a developing device provided with a detecting device for detecting an amount of a developer according to a further embodiment of the present invention.

The measuring-electrode member 20A is disposed at such a position that it contacts the developer and that contact area thereof with the developer changes with the reduction of the developer for example, on the inside surface of the developer-accommodating portion 57 as shown in FIG. 24 or on an inner bottom surface of the developer-accommodating portion 57 as shown in FIG. 25. The reference-electrode member 20B may be disposed at any place in the main assembly of the apparatus if it does not contact the developer as shown in FIG. 24, or it may be disposed on the outside or outer surface of the developer-accommodating portion as shown in FIG. 26, or at such a position within the developer-accommodating portion 57 that it is separated from the developer-accommodating portion by a partition wall 21 so as not to contact the developer, as shown in FIG. 27.

The measuring-electrode member 20A has the same structure as that of Embodiment 1, as has been described in conjunction with FIGS. 10 and 11. More particularly, as shown in FIG. 10, it comprises a pair of electrodes 23, 24 which are arranged in parallel with each other with a predetermined gap therebetween on the substrate 22. In this embodiment, the electrodes 23, 24 have at least one pair of electrode portions 23*a*–23*f*, 24*a*–24*f* juxtaposed in parallel with a predetermined gap G, and the electrode portion 23*a*–23*f*, 24*a*–24*f* are connected to the connecting-electrode portions 23*g*, 24*g*, respectively. Thus, the two electrodes 23 and 24 have a comb-like configuration with the branch portions interlaced with each other. However, the electrode pattern of the measuring-electrode member is not limited to those examples, and for example, as shown in FIG. 11, the electrodes 23, 24 may be extended in a volute pattern with constant gap.

In this embodiment, too, the measuring-electrode member 20A detects the developer remainder in the developer-accommodating portion 57 by detecting the electrostatic capacity between the parallel electrodes 23, 24. Since the developer has a dielectric constant which is larger than that of the air, and therefore, the contact of the developer on the surface of the measuring-electrode member 20A increases the electrostatic capacity between the electrodes 23, 24.

Therefore, according to this embodiment, the measuring-electrode member 20A can detect the developer in the developer container 11A on the basis of the area of the developer contacting the surface of the measuring-electrode member 20A, using a predetermined calibration curve, irrespective of the cross-sectional configuration of the developer container 11A or the configuration of the measuring-electrode member 20A.

The measuring electrode member 20A can be manufactured in the same manner as with Embodiment 1. Therefore, a detailed description will be omitted for simplicity.

As described in the foregoing, according to the detecting device for the amount of the developer of this embodiment, the measuring-electrode member 20A is disposed on the inner surface of the developer-accommodating portion 57 or on such an inner bottom surface that the contact area with a developer reduces with consumption of the developer, and the total amount of the developer in the developer container can be detected by the change of the electrostatic capacity of the measuring electrode member 20A, which change is indicative of the change of the contact area with the developer.

Since the dielectric constant of the developer is larger than that of the air, the electrostatic capacity is larger at the portion where the developer contacts the measuring-electrode member 20A (where the developer exists) than at the portion where no developer is contacted thereto (where the developer does not exist). Thus, the amount of the developer in the developer-accommodating portion 57 can be deduced from the electrostatic capacity.

Figure 28:
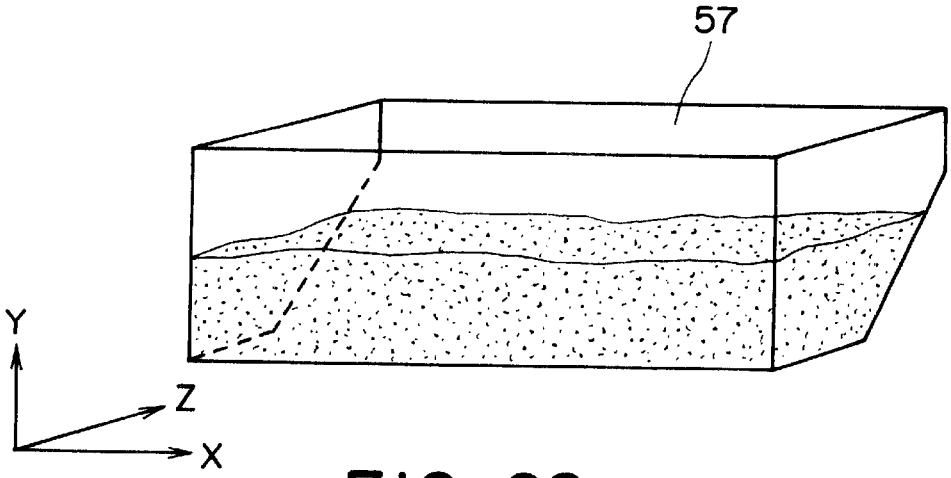
FIG. 28 is an illustration of accommodation of the developer in developer accommodating portion.
Figure 29:
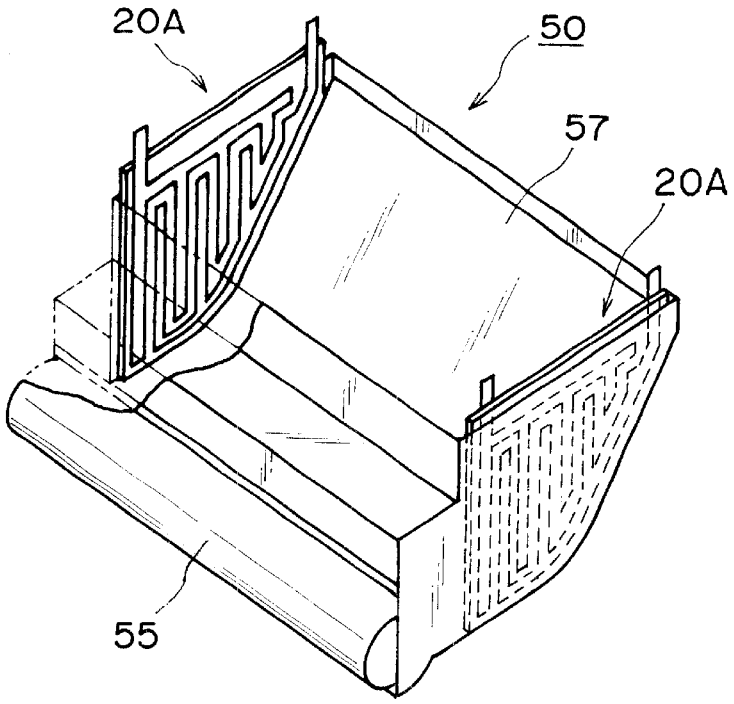
FIG. 29 is a perspective view of a developing device provided with a detecting device for detecting an amount of a developer according to a further embodiment of the present invention.
Figure 30:
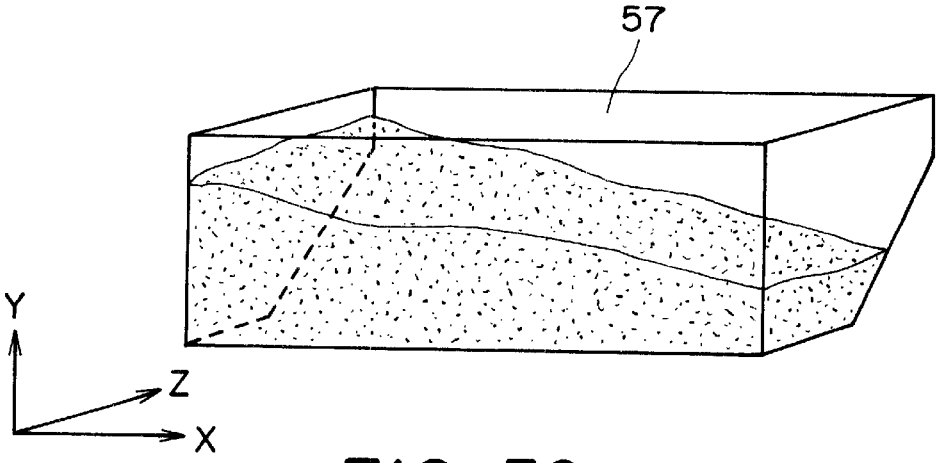
FIG. 30 is an illustration of accommodation of the developer in a developer accommodating portion.

As shown in FIG. 24, by disposing the measuring-electrode member 20A on one inner side of the developer-accommodating portion 57, the percentage of the area contacting the developer to the cross-sectional area of the developer container in the YZ flat surface in FIG. 28, can be deduced or estimated from the detected electrostatic capacity. As shown in FIG. 29, the developer may exist unevenly along the longitudinal direction due to the demounting and mounting of the process cartridge for jam clearance or the like, due to the inclination of the process cartridge or due to an uneven printing pattern, as shown in FIG. 30. By providing the measuring-electrode member 20A at each inner longitudinal end of the developer container, the uneven distribution of the developer can be detected on the basis of the output of the two electrode members 20A, 20A, so that correct detection of the developer remainder is accomplished.

As shown in FIG. 25, when the measuring-electrode member 20A is disposed on the inner bottom surface of the developer container 11A, the percentage of the contact area occupying the bottom area can be estimated so that the influence of the uneven distribution of the developer in the longitudinal direction can be minimized. Since the bottom area is larger than the end area in the developer-accommodating portion 57, the area of the developer-amount detecting member 20A can be made larger than when the developer-amount detecting member 20A is disposed at the end of the developer-accommodating portion 57, so that the amount of the change of the electrostatic capacity can be made larger, that is, the output of the detector can be made larger, and therefore, the measurement error can be minimized.

When the electrode members are provided on the inner bottom surface and the inner end surface or surfaces of the developer accommodating portion 57, the amount of the developer in the developer accommodating portion 57 can be estimated in three dimensions, so that the amount of the developer can be more correctly detected.

According to this embodiment, the developer-remaining-amount detecting device comprises a reference-electrode member 20B having the same structure as the measuring-electrode member 20A, as shown in FIG. 24.

As has been described with Embodiment 1, the reference-electrode member 20B has the same structure as the measurement-electrode member 20A. More particularly, as shown in FIG. 10, it comprises a pair of electrodes 23(23*a*–23*f*) and 24 (24*a*–24*f*) formed parallel with a gap G on the substrate 22, and the two electrodes 23, 24 may be interlaced, or it may be in the form of a volute, as shown in FIG. 11. The reference-electrode member 20B can be manufactured through the same manufacturing process as with the printed boards and the wiring patterns.

According to this embodiment, the electrostatic capacity of the reference-electrode member 20B changes in accordance with the ambient condition, such as the temperature and the humidity, as described hereinbefore, so that it functions as a calibration member (reference-electrode or member) for the measuring-electrode member 20A.

Thus, according to the detecting device for the amount of the developer of this embodiment, the output of the measuring-electrode member 20A is compared with the output of the reference-electrode member 20B which is influenced by the change of the ambient conditions. For example, the electrostatic capacity of the reference-electrode member 20B in a predetermined state is set to be the same as the electrostatic capacity of the measuring-electrode member 20A when no developer exists, and then, the difference of the outputs of the reference-electrode member 20B and the measuring-electrode member 20A is indicative of the change of the electrostatic capacity caused by the presence of the developer, so that the accuracy of the detection of the remaining amount of the developer can be enhanced.

The detection principle on the developer amount and the detecting device for the amount of the developer are the same as those of the Embodiment 1 has been described in conjunction with FIG. 17, and therefore, the description thereof is omitted for simplicity.

As described in the foregoing, according to the developer-amount detecting device of this embodiment, use is made of the reference electrode member 20B (calibration element) exhibiting the same capacity change in accordance with the ambient condition change as the measuring-electrode member 20A, so that the detection error due to the variation of the ambient condition can be canceled or compensated for so that a high accuracy in the detection for the developer remainder can be accomplished.

According to this embodiment, the reference-electrode member 20B as the calibration member may have another structure and can be disposed at another place.

Figure 31:
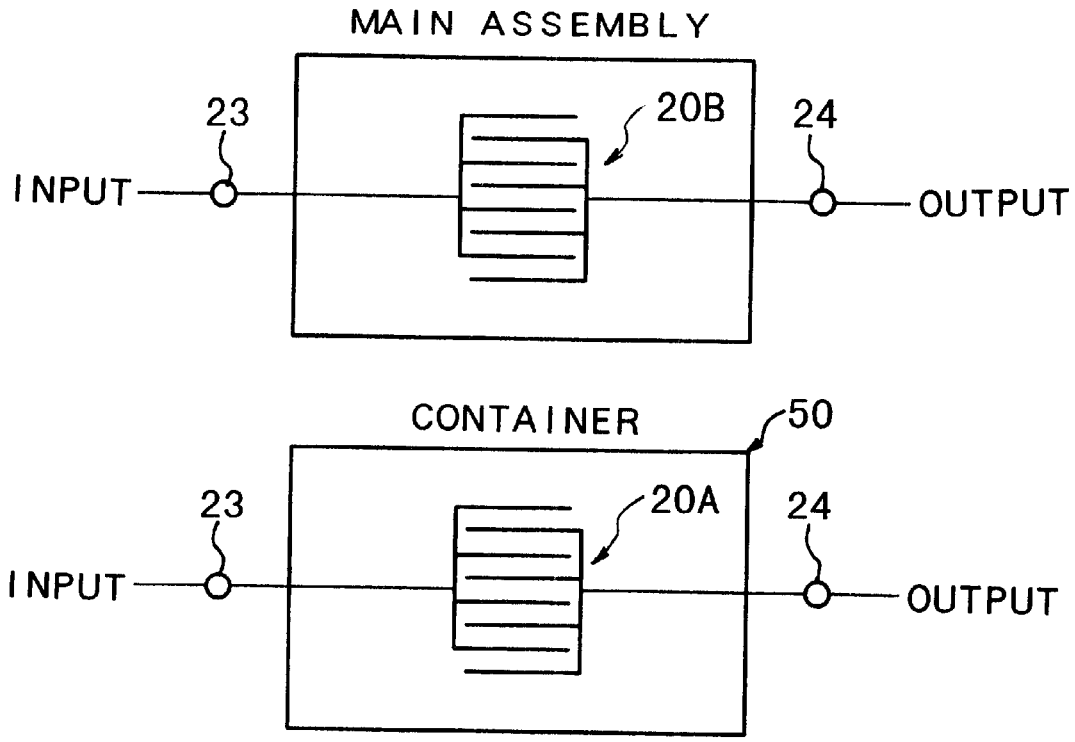
FIG. 31 is an illustration of arrangements of a measuring electrode member and a reference electrode member according to an embodiment of the present invention.
Figure 32:
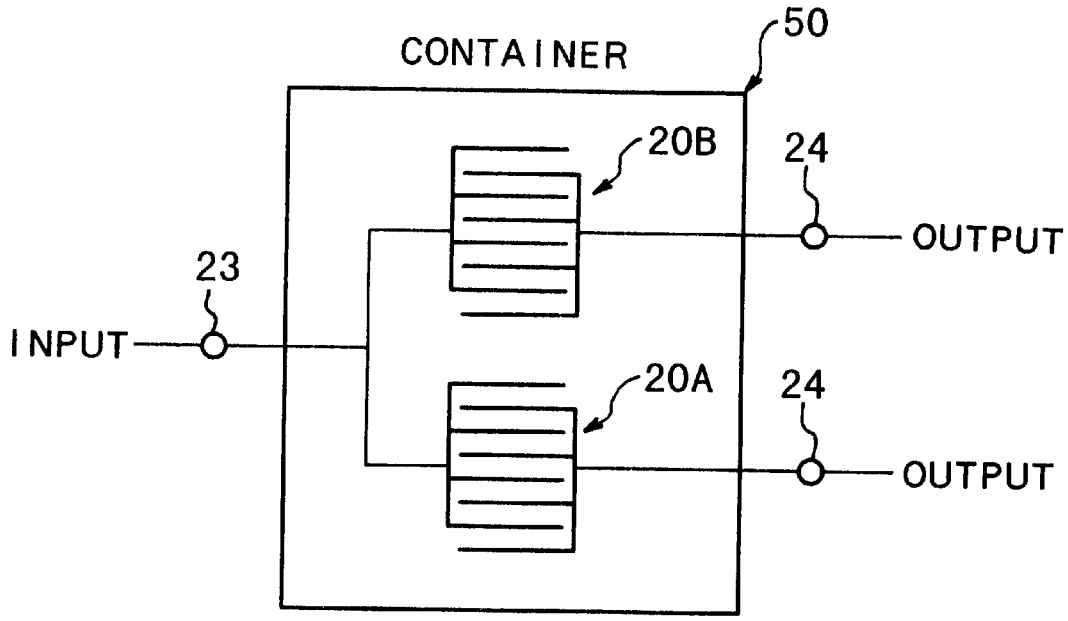
FIG. 32 is an illustration of arrangements of a measuring electrode member and a reference electrode member according to a further embodiment of the present invention.

For example, as shown in FIGS. 24 and 31, the reference-electrode member 20B having the same structure as the measuring-electrode member 20A may be placed in the main assembly of the image forming apparatus. With this structure, the electrostatic capacity of the reference-electrode member 20B changes in the same manner as the measuring-electrode member 20A in accordance with the change of the ambiance, so that output of the changes attributable to the ambience variation can be canceled from the output of the measuring-electrode member 20A.

As shown in FIGS. 26 and 27, the measuring-electrode member 20A and the reference-electrode member 20B having the same structure as the measuring-electrode member can be placed in the developer-accommodating portion 57 of the developing device 50. In this case, since the measuring-electrode member 20A and the reference-electrode member 20B for calibration are provided in the developer-accommodating portion 57, the variation due to the ambience change can be canceled, and since the measurement-electrode member (detecting member) 20A and the reference-electrode member (calibration member) 20B are placed in the same ambient conditions, the detection accuracy can be enhanced.

In the description of the foregoing embodiment, the electrode patterns 23, 24 of the reference-electrode member 20B have substantially the same electrostatic capacities, and substantially the same pattern widths, lengths, gaps and opposing areas. In such a case, the pattern design is easy, and the variations resulting from the differences in the electrostatic capacity among the products and the differences in the ambient conditions, can be minimized.

In addition, it is possible that the area of the electrode patterns 23, 24 of the reference-electrode member 20B for calibration is different from the area of the electrode patterns 23, 24 of the measuring electrode member 20A. In this case, the output of the reference-electrode member 20B is multiplied by a predetermined coefficient, and the multiplied output is compared with the output of the measuring-electrode member 20A. Using such a structure, the size of the reference-electrode member 20B can be reduced so that the space occupied by the detecting member can be reduced. Both of the members 20A and 20B are disposed at the same side of the developer accommodating portion, and in this case, the percentage of the pattern of the detecting member 20A in the limited area can be increased so that degree of the change of the electrostatic capacity can be increased, and the accuracy can be enhanced.

In the foregoing, the same configurations or same dimensions do not mean exactly identical configuration or dimensions, and do not exclude those having a difference due to manufacturing errors or the like as long as the intended detection can be made with practical accuracy.

As described in the foregoing, according to this employment of the present invention, the developer-accommodating portion 57 is provided with the measuring-electrode member 20A and the reference-electrode member 20B. Further preferably, the developing zone 56 of the developing device is provided with an antenna rod, that is, electrode rode 54 (FIG. 23) which is extended through a predetermined length in the longitudinal direction of the developing sleeve 55 with a predetermined gap from the developing sleeve 55. By doing so, the change of the electrostatic capacity between the developing sleeve 55 and the electrode rod 25 can be detected, so that emptiness of the developer can be detected.

According to the image forming apparatus of this embodiment, the amount of the developer in the developer-accommodating portion 57 can be detected substantially in real-time, and on the basis of the detection, the consumption amount of the developer may be displayed so as to influence the user to prepare the replenishing cartridge and further to supply the developer upon the display of the emptiness.

In this embodiment, similarly to Embodiment 1, the detected information provided by the developer-amount detecting device is displayed on the screen of the terminal equipment such as a personal computer of the user in the manner, shown in FIGS. 20 and 21, or as shown in FIG. 22, and the main assembly of the electrophotographic image forming apparatus may be provided with a display portion of an LED or the like, and the LED is flickered in accordance with the amount of the developer.

(Embodiment 3)

Figure 33:
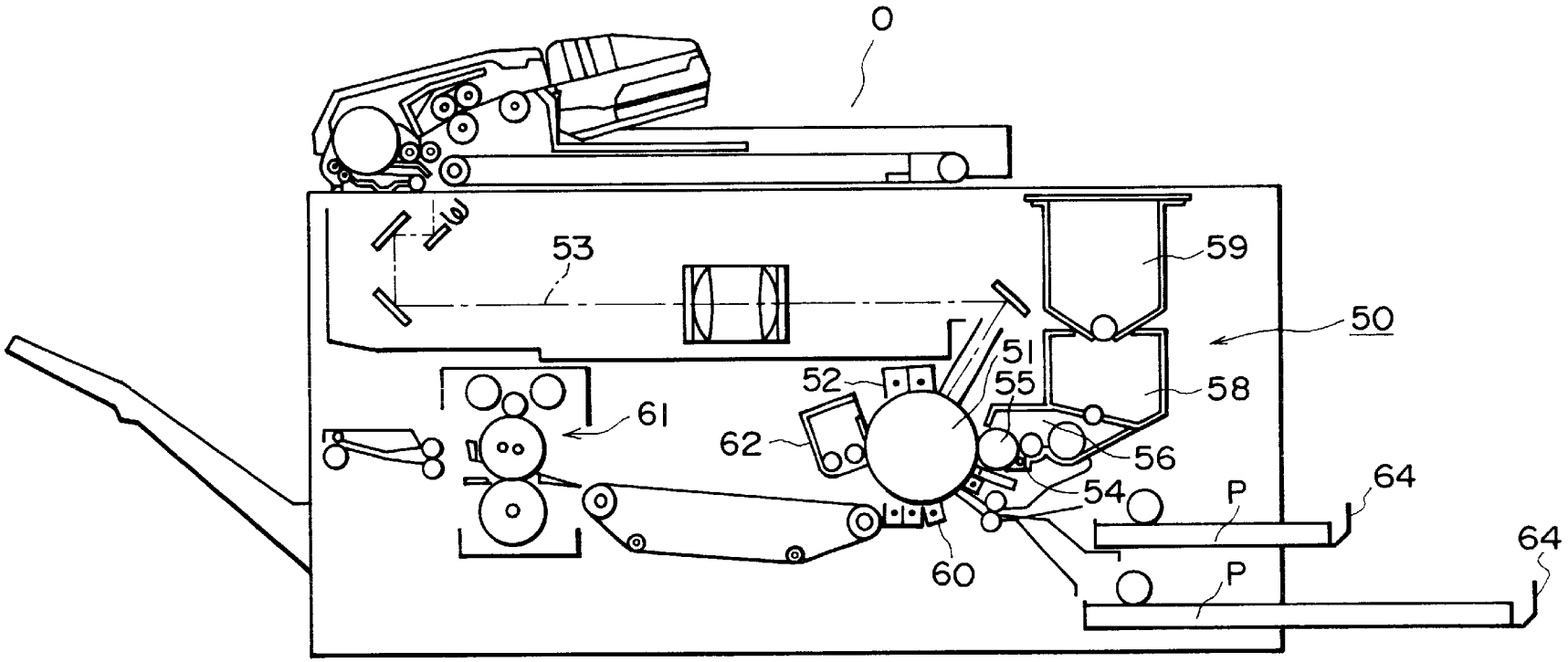
FIG. 33 is a schematic illustration of an electrophotographic image forming apparatus according to a further embodiment of the present invention.

FIG. 33 shows an electrophotographic image forming apparatus according to a further embodiment of the present invention. The electrophotographic image forming apparatus of this embodiment is generally the same as the image forming apparatus of Embodiment 2 except for the developing device 50. Therefore, the same reference numerals are assigned to the element having the corresponding functions, and a detailed description thereof is omitted for simplicity.

In this embodiment, the developing device 50 comprises a developing zone 56 including a developing sleeve 55 (developer carrying member), a developer hopper 58 for accommodating the developer and supplying the developer to the developing zone 56, and a developer-supply container 59 for supplying the developer to the developer hopper 58.

In such a developing device 50, similarly to the developer-accommodating portion 57 according to Embodiment 2, the developer hopper 58 and the developer-supply container 59 constitute a developer-supply container, and therefore, the developer-amount detecting device according to the present invention is provided in the developer-hopper 58 and the developer supply container 59.

More particularly, in the case that the developer amount detecting member 20A is provided in the developer hopper 58, the developer remainder in the developer hopper 58 is detected, and in the case that developer-amount detecting member is provided in the developer-supply container 59, the developer remainder in the developer-supply container 59 can be detected.

In this embodiment, even in the case that developer-amount detecting members 20A are provided in the developer hopper 58 and the developer-supply container 59, respectively, in order to detect the developer remainders in the developer hopper 58 and the developer-supply container 59, the reference-electrode member 20B may be provided in the developer hopper 58, the developer-supply container 59, or the main assembly of the electrophotographic image forming apparatus, for all the developer-amount detecting members.

In the foregoing embodiments, the range of substantially real-time detection of the remaining amount of the developer is not limited to the full range, that is, the range of 100% (Full) –0% (Empty). The substantially real-time detection range may be properly determined by one skilled in the art, for example, the range of, 100%–25%, or, 30%–0%, or the like. The remaining amount of 0% does not necessarily mean that there exists no developer at all. The remaining amount of 0% may be indicative of the event that a developer has decreased to such an extent that predetermined image quality is not provided.

According to an aspect of the present invention, the first electrostatic-capacity generating portion includes a first electroconductive portion and a second electroconductive portion, and the second electrostatic-capacity generating portion includes a third electroconductive portion and a fourth electroconductive portion, wherein the first electroconductive portion and the second electroconductive portion are juxtaposed with each other, and the third electroconductive portion and the fourth electroconductive portion are juxtaposed with each other.

According to another aspect of the present invention, each of the first electroconductive portion and the second electroconductive portion includes portions that are arranged at regular intervals, and each of the third electroconductive portion and the fourth electroconductive portion includes portions that are arranged at regular intervals, and the regular interval portions of the first electroconductive portion and the second electroconductive portion are parallel with each other, and the regular interval portions of the third electroconductive portion and the fourth electroconductive portion are parallel with each other.

According to a further aspect of the present invention, the first electroconductive portion and the second electroconductive portion include alternatingly arranged portions, and the third electroconductive portion and the fourth electroconductive portion include alternatingly arranged portions, and the first electroconductive portion includes a base portion and a plurality of branched portions extended from the base portion, and the second electroconductive portion includes a base portion and a plurality of branched portions extended from the base portion of the second electroconductive portion, wherein the branched portions of the first electroconductive portion and the branched portions of the second electroconductive portion are alternatingly arranged in parallel with each other at regular intervals.

According to a further aspect of the present invention, the first electroconductive portion and the second electroconductive portion include portions that are opposed to each other, wherein the branched portions of the first electroconductive portion are expended toward the second electroconductive portion, and the branched portion of the second electroconductive portion are expended toward the first electroconductive portion.

According to a further aspect of the present invention, the third electroconductive portion includes a base portion and a plurality of branched portions extended from the base portion, and the fourth electroconductive portion includes a base portion and a plurality of branched portions extended from the base portion of the fourth electroconductive portion, wherein the branched portions of the third electroconductive portion and the branched portions of the fourth electroconductive portion are alternatingly arranged in parallel with each other at regular intervals.

According to a further aspect of the present invention, the third electroconductive portion and the fourth electroconductive portion include portions which are opposed to each other, wherein the branched portions of the third electroconductive portion are expended toward the fourth electroconductive portion, and the branched portion of the fourth electroconductive portion are expended toward the third electroconductive portion.

According to a further aspect of the present invention, the first electrostatic-capacity generating portion and the second electrostatic-capacity generating portion have the same configuration, and the first electrostatic-capacity generating portion and the second electrostatic-capacity generating portion generate the same electrostatic capacities when voltages are applied thereto, when the first electrostatic-capacity generating portion and the second electrostatic-capacity generating portion do not contact the developer.

According to a further aspect of the present invention, the first electrostatic-capacity generating portion and the second electrostatic-capacity generating portion are disposed inside the developer-accommodating portion, and the first electrostatic-capacity generating portion is disposed inside the developer-accommodating portion, and the second electrostatic-capacity generating portion is disposed outside the developer-accommodating portion.

According to a further aspect of the present invention, the amount of the developer accommodated in the developer-accommodating portion is detected substantially in real-time on the basis of the electrostatic capacities generated by the first electrostatic-capacity generating portion and the second electrostatic-capacity generating portion when they are supplied with voltages, and a result of the detection is continuously or stepwisely displayed.

As described in the foregoing, according to the present invention, the remaining amount of the developer in the developer-accommodating portion can be detected in accordance with the consumption of the developer substantially in real-time. Regarding the detection of the remaining amount of the developer using the change of the electrostatic capacity between electrodes, the measurement errors attributable to the variation of the ambient conditions can be reduced.

While the invention has been described with reference to the structures disclosed herein, it is not confined to the details set forth and this application is intended to cover such modifications or changes as may come within the purposes of the improvements or the scope of the following claims.

What is claimed is:

1. An electrophotographic image forming apparatus for forming an image on a recording material, comprising:

(a) an electrophotographic photosensitive member;

(b) a developer accommodating portion for accommodating a developer;

(c) developing means for developing an electrostatic latent image formed on said electrophotographic photosensitive member using the developer accommodated in said developer accommodating portion;

(d) a first electrostatic capacity generating portion disposed at such a position that said first electrostatic capacity generating portion is contacting the developer accommodated in said developer accommodating portion when a predetermined amount of the developer is accommodated in said developer accommodating portion, said first electrostatic capacity generating portion generating an electrostatic capacity corresponding to an amount of the developer when said first electrostatic capacity generating portion is supplied with a voltage, and a second electrostatic capacity generating portion disposed at such a position that said second electrostatic capacity generating portion is not contacted to the developer accommodated in said developer accommodating portion, said second electrostatic capacity generating portion generating a reference electrostatic capacity, which is a developer-free electrostatic capacity, when said second electrostatic capacity generating portion is supplied with a voltage;

(e) developer amount detecting means for detecting an amount of the developer accommodated in said developer accommodating portion on the basis of the electrostatic capacity generated by said first electrostatic capacity generating portion and the reference electrostatic capacity generated by said second electrostatic capacity generating portion; and (f) electrostatic latent image forming means for forming an electrostatic latent image on said electrophotographic photosensitive member.

2. An apparatus according to claim 1, wherein said first electrostatic capacity generating portion includes a first electroconductive portion and a second electroconductive portion, wherein said second electrostatic capacity generating portion includes a third electroconductive portion and a fourth electroconductive portion, wherein said first electroconductive portion and said second electroconductive portion are juxtaposed with each other, and said wherein third electroconductive portion and said fourth electroconductive portion are juxtaposed with each other.

3. An apparatus according to claim 2, wherein each of said first electroconductive portion and said second electroconductive portion includes portions that are arranged at regular intervals, and each of said third electroconductive portion and said fourth electroconductive portion includes portions that are arranged at regular intervals.

4. An apparatus according to claim 3, wherein the regular interval portions of said first electroconductive portion and said second electroconductive portion are parallel with each other, and wherein the regular interval portions of said third electroconductive portion and said fourth electroconductive portion are parallel with each other.

5. An apparatus according to claim 2, 3 or 4, wherein said first electroconductive portion and said second electroconductive portion include alternatingly arranged portions, and wherein said third electroconductive portion and said fourth electroconductive portion include alternatingly arranged portions.

6. An apparatus according to any one of claims 2–4, wherein said first electroconductive portion includes a base portion and a plurality of branched portions extended from the base portion, and said second electroconductive portion includes a base portion and a plurality of branched portions extended from the base portion of said second electroconductive portion, wherein said branched portions of said first electroconductive portion and the branched portions of said second electroconductive portion are alternatingly arranged in parallel with each other at regular intervals.

7. An apparatus according to claim 6, wherein said first electroconductive portion and said second electroconductive portion include portions that are opposed to each other, wherein branched portions of said first electroconductive portion are extended toward said second electroconductive portion, and branched portions of said second electroconductive portion are extended toward said first electroconductive portion.

8. An apparatus according to any one of claims 2–4, wherein said third electroconductive portion includes a base portion and a plurality of branched portions extended from the base portion, and said fourth electroconductive portion includes a base portion and a plurality of branched portions extended from the base portion of said fourth electroconductive portion, wherein said branched portions of said third electroconductive portion and the branched portions of said fourth electroconductive portion are alternatingly arranged in parallel with each other at regular intervals.

9. An apparatus according to claim 8 wherein said third electroconductive portion and said fourth electroconductive portion include portions which are opposed to each other, wherein the branched portions of said third electroconductive portion are extended toward said fourth electroconductive portion, and the branched portions of said fourth electroconductive portion are extended toward said third electroconductive portion.

10. An apparatus according to claim 1, wherein said first electrostatic capacity generating portion and said second electrostatic capacity generating portion have the same configuration.

11. An apparatus according to any one of claim 1 and 10, wherein said first electrostatic capacity generating portion and said second electrostatic capacity generating portion generate the same electrostatic capacitances when voltages are applied thereto, when said first electrostatic capacity generating portion and said second electrostatic capacity generating portion are not contacted to the developer.

12. An apparatus according to any one of claim 1 and 10, wherein said first electrostatic capacity generating portion and said second electrostatic capacity generating portion are disposed inside said developer accommodating portion.

13. An apparatus according to any one of claim 1 and 10, wherein said first electrostatic capacity generating portion is disposed inside said developer accommodating portion, and said second electrostatic capacity generating portion is disposed outside said developer accommodating portion.

14. An apparatus according to claim 1, wherein the amount of the developer accommodated in said developer accommodating portion is detected substantially in real-time on the basis of the electrostatic capacities generated by said first electrostatic capacity generating portion and said second electrostatic capacities generating portion when they are supplied with voltages, and a result of the detection is continuously displayed.

15. An apparatus according to claim 1, wherein the amount of the developer accommodated in said developer accommodating portion is detected substantially in real-time on the basis of the electrostatic capacities generated by said first electrostatic capacity generating portion and said second electrostatic capacity generating portion when they are supplied with voltages, and a result of the detection is stepwisely displayed.

16. A process cartridge detachably mountable to a main assembly of an electrophotographic image forming apparatus, said process cartridge comprising:

(a) an electrophotographic photosensitive member;

(b) process means actable on said electrophotographic photosensitive member;

(c) first and second electrostatic capacity generating portions for permitting the main assembly of the image forming apparatus to detect an amount of the developer to be used for developing an electrostatic latent image formed on said photosensitive member when said process cartridge is mounted to the main assembly of the image forming apparatus, said first electrostatic capacity generating portion being disposed at such a position that said first electrostatic capacity generating portion is contacted to the developer accommodated in said developer accommodating portion, and said first electrostatic capacity generating portion generating an electrostatic capacity corresponding to an amount of the developer when said first electrostatic capacity generating portion is supplied with a voltage;

said second electrostatic capacity generating portion being disposed at such a position that said second electrostatic capacity generating portion is not contacted to the developer, said second electrostatic capacity generating portion generating a reference electrostatic capacity which is a developer-free electrostatic capacity when said second electrostatic capacity generating portion is supplied with a voltage;

(d) an electrical contact for transmitting to the main assembly of said electrophotographic image forming apparatus a first electric signal corresponding to an electrostatic capacity generated by said first electrostatic capacity generating portion when the voltage is applied thereto from the main assembly of said electrophotographic image forming apparatus and a second electric signal corresponding to the reference electrostatic capacity generated by said second electrostatic capacity generating portion when the voltage is applied thereto from the main assembly of said electrophotographic image forming apparatus.

17. A process cartridge according to claim 16, wherein said electrical contact is provided exposed from a cartridge frame at two portions that are away from each other.

18. A process cartridge according to claim 16, wherein said electrical contact includes a first electrical contact element for transmitting the first electric signal to the main assembly of the electrophotographic image forming apparatus and a second electrical contact element for transmitting the second electric signal to the main assembly of the electrophotographic image forming apparatus.

19. A process cartridge according to any one of claims 16, 17 and 18, wherein said first electrostatic capacity generating portion and said second electrostatic capacity generating portion are disposed inside a developer accommodating portion accommodating the developer.

20. A process cartridge according to any one of claims 16–18, wherein said first electrostatic capacity generating portion is disposed inside a developer accommodating portion accommodating the developer, and said second electrostatic capacity generating portion is disposed outside said developer accommodating portion.

21. A process cartridge detachably mountable to a main assembly of an electrophotographic image forming apparatus including a second electrostatic capacity generating portion for generating a reference electrostatic capacity which is a developer-free electrostatic capacity, comprising:

(a) an electrophotographic photosensitive member;

(b) process means actable on said electrophotographic photosensitive member;

(c) a first electrostatic capacity generating portion for permitting the main assembly of the image forming apparatus to detect an amount of the developer to be used for developing an electrostatic latent image formed on said photosensitive member when said process cartridge is mounted to the main assembly of said electrophotographic image forming apparatus, said first electrostatic capacity generating portion being disposed at such a position that said first electrostatic capacity generating portion is contacted to the developer accommodated in said developer accommodating portion, and said first electrostatic capacity generating portion generating an electrostatic capacity corresponding to an amount of the developer when said first electrostatic capacity generating portion is supplied with the a voltage;

(d) an electrical contact for transmitting to the main assembly of said electrophotographic image forming apparatus a first electric signal corresponding to an electrostatic capacity generated by said first electrostatic capacity generating portion when the voltage is applied thereto from the main assembly of said electrophotographic image forming apparatus, when said process cartridge is mounted to the main assembly of said electrophotographic image forming apparatus;

wherein an amount of the developer accommodated in said process cartridge is detected by the main assembly of said electrophotographic image forming apparatus on the basis of the first electric signal transmitted through said electrical contact from said process cartridge and a second electric signal corresponding to the reference electrostatic capacity generated by the second electrostatic capacity generating portion when a voltage is applied thereto from the main assembly of said electrophotographic image forming apparatus, when said process cartridge is mounted to the main assembly of said electrophotographic image forming apparatus.

22. A process cartridge according to claim 21, said first electrostatic capacity generating portion being disposed inside a developer accommodating portion accommodating the developer.

23. A process cartridge according to any one of claims 21 and 22, wherein said first electrostatic capacity generating portion includes a first electroconductive portion and a second electroconductive portion, and said second electrostatic capacity generating portion includes a third electroconductive portion and a fourth electroconductive portion, wherein said first electroconductive portion and said second electroconductive portion are juxtaposed with each other, and said third electroconductive portion and said fourth electroconductive portion are juxtaposed with each other.

24. A process cartridge according to claim 23, wherein each of said first electroconductive portion and said second electroconductive portion includes portions that are arranged at regular intervals, and each of said third electroconductive portion and said fourth electroconductive portion includes portions that are arranged at regular intervals.

25. A process cartridge according to claim 24, wherein the regular interval portions of said first electroconductive portion and said second electroconductive portion are parallel with each other, and wherein the regular interval portions of said third electroconductive portion and said fourth electroconductive portion are parallel with each other.

26. A process cartridge according to claim 25, wherein said first electroconductive portion and said second electroconductive portion include alternatingly arranged portions, and said third electroconductive portion and said fourth electroconductive portion include alternatingly arranged portions.

27. A process cartridge according to claim 23, wherein said first electroconductive portion includes a base portion and a plurality of branched portions extended from the base portion, and said second electroconductive portion includes a base portion and a plurality of branched portions extended from the base portion of said second electroconductive portion, wherein said branched portions of said first electroconductive portion and the branched portions of said second electroconductive portion are alternatingly arranged in parallel with each other at regular intervals.

28. A process cartridge according to claim 27, wherein said first electroconductive portion and said second electroconductive portion include portions which are opposed to each other, wherein the branched portions of said first electroconductive portion are extended toward said second electroconductive portion, and the branched portions of said second electroconductive portion are extended toward said first electroconductive portion.

29. A process cartridge according to claim 23, wherein said third electroconductive portion includes a base portion and a plurality of branched portions extended from the base portion, and said fourth electroconductive portion includes a base portion and a plurality of branched portions extended from the base portion of said fourth electroconductive portion, wherein said branched portions of said third electroconductive portion and the branched portions of said fourth electroconductive portion are alternatingly arranged in parallel with each other at regular intervals.

30. A process cartridge according to claim 29, wherein said third electroconductive portion and said fourth electroconductive portion include portions which are opposed to each other, wherein the branched portions of said third electroconductive portion are extended toward said fourth electroconductive portion, and the branched portions of said fourth electroconductive portion are extended toward said third electroconductive portion.

31. An apparatus according to claim 29, wherein said first electrostatic capacity generating portion and the second electrostatic capacity generating portion have the same configuration.

32. An process cartridge according to claim 21, wherein said first electrostatic capacity generating portion and said second electrostatic capacity generating portion generate the same electrostatic capacitances when voltages are applied thereto, when said first electrostatic capacity generating portion and the second electrostatic capacity generating portion are not contacted to the developer.

33. A process cartridge according to claim 16 or 21, wherein the amount of the developer accommodated in said process cartridge is detected substantially in real-time on the basis of the electrostatic capacities generated by said first electrostatic capacity generating portion and the second electrostatic capacity generating portion when they are supplied with voltages, and a result of the detection is continuously displayed.

34. A process cartridge according to claim 16 or 21, wherein the amount of the developer accommodated in said process cartridge is detected substantially in real-time on the basis of the electrostatic capacities generated by said first electrostatic capacity generating portion and the second electrostatic capacity generating portion when they are supplied with voltages, and a result of the detection is stepwisely displayed.

35. A process cartridge according to claim 16 or 21, wherein said process means includes at least one of developing means for developing an electrostatic latent image formed on said electrophotographic photosensitive member, charging means for electrically recharging said electrophotographic photosensitive member, and cleaning means for removing developer remaining on said electrophotographic photosensitive member.

36. An electrophotographic image forming apparatus for forming an image on a recording material, to which apparatus a process cartridge is detachably mountable, said apparatus comprising:

(a) mounting means for detachably mounting said process cartridge, said process cartridge including:

an electrophotographic photosensitive member;

process means actable on said electrophotographic photosensitive member;

a developer accommodating portion for accommodating a developer for developing an electrostatic latent image formed on said electrophotographic photosensitive member;

first and second electrostatic capacity generating portions for permitting the main assembly of the image forming apparatus to detect an amount of the developer to be used for developing an electrostatic latent image formed on said photosensitive member when said process cartridge is mounted to the main assembly of the image forming apparatus, said first electrostatic capacity generating portion being disposed at such a position that said first electrostatic capacity generating portion is contacted to the developer accommodated in said developer accommodating portion, and said first electrostatic capacity generating portion generating an electrostatic capacity corresponding to an amount of the developer when said first electrostatic capacity generating portion is supplied with a voltage;

said second electrostatic capacity generating portion being disposed at such a position that said second electrostatic capacity generating portion is not contacted to the developer, said second electrostatic capacity generating portion generating a reference electrostatic capacity, which is a developer-free electrostatic capacity, when said second electrostatic capacity generating portion is supplied with a voltage;

an electrical contact for transmitting to the main assembly of said electrophotographic image forming apparatus a first electric signal corresponding to an electrostatic capacity generated by said first electrostatic capacity generating portion when the voltage is applied thereto from the main assembly of said electrophotographic image forming apparatus and a second electric signal corresponding to the reference electrostatic capacity generated by said second electrostatic capacity generating portion when the voltage is applied thereto from the main assembly of said electrophotographic image forming apparatus;

(b) developer amount detecting means for detection an amount of the developer accommodated in the developer accommodating portion of said process cartridge on the basis of the first electric signal and the second electric signal; and (c) electrostatic latent image forming means for forming an electrostatic latent image on said electrophotographic photosensitive member.

37. An electrophotographic image forming apparatus for forming an image on a recording material, to which apparatus a process cartridge is detachably mountable, said apparatus comprising:

(a) mounting means for mounting said process cartridge which is detachably mountable to a main assembly of said electrophotographic image forming apparatus including a second electrostatic capacity which is a developer-free electrostatic capacity, said process cartridge including:

an electrophotographic photosensitive member;

process means actable on said electrophotographic photosensitive member;

a developer accommodating portion for accommodating a developer for developing an electrostatic latent image formed on said electrophotographic photosensitive member;

a first electrostatic capacity generating portion for permitting the main assembly of the image forming apparatus to detect an amount of the developer to be used for developing an electrostatic latent image formed on said photosensitive member when said process cartridge is mounted to the main assembly of the image forming apparatus, said first electrostatic capacity generating portion being disposed at such a position that said first electrostatic capacity generating portion is contacted to the developer accommodated in said developer accommodating portion, and said first electrostatic capacity generating portion generating an electrostatic capacity corresponding to an amount of the developer when said first electrostatic capacity generating portion is supplied with a voltage;

an electrical contact for transmitting to the main assembly of said electrophotographic image forming apparatus a first electric signal corresponding to an electrostatic capacity generated by said first electrostatic capacity generating portion when the voltage is applied thereto from the main assembly of said electrophotographic image forming apparatus, when said process cartridge is mounted to the main assembly of said electrophotographic image forming apparatus;

wherein an amount of the developer accommodated in said process cartridge is detected by the main assembly of said electrophotographic image forming apparatus on the basis of the first electric signal transmitted through said electrical contact from said process cartridge and a second electric signal corresponding to the reference electrostatic capacity generated by a second electrostatic capacity generating portion when a voltage is applied thereon from the main assembly of said electrophotographic image forming apparatus, when said process cartridge is mounted to the main assembly of said electrophotographic image forming apparatus;

(b) detecting means, provided in the main assembly of said electrophotographic image forming apparatus, for detecting an amount of the developer accommodated in said process cartridge on the basis of the first electric signal transmitted through said electrical contact from said process cartridge and the second electric signal corresponding to the reference electrostatic capacity generated by the second electrostatic capacity generating portion when a voltage is applied thereto from the main assembly of said electrophotographic image forming apparatus, when said process cartridge is mounted to the main assembly of said electrophotographic image forming apparatus, wherein an amount of the developer accommodated in said process cartridge is detected by the main assembly of said electrophotographic image forming apparatus on the basis of the first electric signal transmitted through said electrical contact from said process cartridge and a second electric signal corresponding to the reference electrostatic capacity generated by the second electrostatic capacity generating portion when a voltage is applied thereto from the main assembly of said electrophotographic image forming apparatus, when said process cartridge is mounted to the main assembly of said electrophotographic image forming apparatus.

38. A developing device for an electrophotographic image forming apparatus, said developing device comprising:

(a) a developer accommodating portion for accommodating a developer;

(b) developing means for developing an electrostatic latent image formed on an electrophotographic photosensitive member using the developer accommodated in said developer accommodating portion;

(c) a first electrostatic capacity generating portion disposed at such a position that said first electrostatic capacity generating portion is contacted to the developer accommodated in said developer accommodating portion when a predetermined amount of the developer is accommodated in said developer accommodating portion, said first electrostatic capacity generating portion generating an electrostatic capacity corresponding to an amount of the developer when said first electrostatic capacity generating portion is supplied with a voltage;

(d) a second electrostatic capacity generating portion disposed at such a position that said second electrostatic capacity generating portion is not contacted to the developer accommodated in said developer accommodating portion, said second electrostatic capacity generating portion generating a reference electrostatic capacity, which is a developer-free electrostatic capacity, when said second electrostatic capacity generating portion is supplied with a voltage; and (f) an electrical contact for transmitting to a main assembly of said electrophotographic image forming apparatus a first electric signal corresponding to the electrostatic capacity generated by said first electrostatic capacity generating portion when the voltage is applied thereto from the main assembly of said electrophotographic image forming apparatus and a second electric signal corresponding to the reference electrostatic capacity generated by said second electrostatic capacity generating portion when a voltage is applied thereto from the main assembly of said electrophotographic image forming apparatus, when said developing device is mounted to the main assembly of said electrophotographic image forming apparatus.

39. A device according to claim 38, wherein said electrical contact is provided exposed from a developing device frame at two portions which are away from each other.

40. A device according to claim 38 or 39, said developing device being detachably mountable to the main assembly of said electrophotographic image forming apparatus or is fixed thereto.

41. A device according to claim 38, wherein said first electrostatic capacity generating portion is disposed inside said developer accommodating portion, and said second electrostatic capacity generating portion is disposed outside said developer accommodating portion.

42. A device according to claim 38 or 39, wherein said electrical contact includes a first electrical contact element for transmitting the first electric signal to the main assembly of said electrophotographic image forming apparatus and a second electrical contact element for transmitting the second electric signal to the main assembly of said electrophotographic image forming apparatus.

43. A device according to claim 38, wherein said first electrostatic capacity generating portion and said second electrostatic capacity generating portion are disposed inside said developer accommodating portion.

44. A device according to claim 38, wherein said first electrostatic capacity generating portion includes a first electroconductive portion and a second electroconductive portion, wherein said second electrostatic capacity generating portion includes a third electroconductive portion and a fourth electroconductive portion, wherein said first electroconductive portion and said second electroconductive portion are juxtaposed with each other, and wherein said third electroconductive portion and said fourth electroconductive portion are juxtaposed with each other.

45. A developing device according to claim 44, wherein each of said first electroconductive portion and said second electroconductive portion includes portions that are arranged at regular intervals, and each of said third electroconductive portion and said fourth electroconductive portion includes portions that are arranged at regular intervals.

46. A device according to claim 45, wherein the regular interval portions of said first electroconductive portion and said second electroconductive portion are parallel with each other, and wherein the regular interval portions of said third electroconductive portion and said fourth electroconductive portion are parallel with each other.

47. A device according to claim 44, 45 or 46, wherein said first electroconductive portion and said second electroconductive portion include alternatingly arranged portions, and wherein said third electroconductive portion and said fourth electroconductive portion include alternatingly arranged portions.

48. A device according to any one of claims 44–46, wherein said first electroconductive portion includes a base portion and a plurality of branched portions extended from the base portion, and said second electroconductive portion includes a base portion and a plurality of branched portions extended from the base portion of said second electroconductive portion, wherein said branched portions of said first electroconductive portion and the branched portions of said second electroconductive portion are alternatingly arranged in parallel with each other at regular intervals.

49. A developing device according to claim 48, wherein said first electroconductive portion and said second electroconductive portion include portions which are opposed to each other, wherein the branched portions of said first electroconductive portion are extended toward said second electroconductive portion, and the branched portions of said second electroconductive portion are extended toward said first electroconductive portion.

50. A device according to any one of claims 44–46, wherein said third electroconductive portion includes a base portion and a plurality of branched portions extended from the base portion, and said fourth electroconductive portion includes a base portion and a plurality of branched portions extended from the base portion of said fourth electroconductive portion, wherein said branched portions of said third electroconductive portion and the branched portions of said fourth electroconductive portion are alternatingly arranged in parallel with each other at regular intervals.

51. A developing device according to claim 50, wherein said third electroconductive portion and said fourth electroconductive portion include portions which are opposed to each other, wherein the branched portions of said third electroconductive portion are extended toward said fourth electroconductive portion, and the branched portions of said fourth electroconductive portion are extended toward said third electroconductive portion.

52. A device according to claim 38, wherein said first electrostatic capacity generating portion and said second electrostatic capacity generating portion have the same configuration.

53. A device according to any one of claim 38 and 52, wherein said first electrostatic capacity generating portion and said second electrostatic capacity generating portion generate the same electrostatic capacitances when voltages are applied thereto, when said first electrostatic capacity generating portion and said second electrostatic capacity generating portion are not contacted to the developer.

54. A developer supply container for supplying a developer to a main assembly of an electrophotographic image forming apparatus, said developer supply container comprising:

(a) a developer accommodating portion for accommodating a developer;

(b) a first electrostatic capacity generating portion disposed at such a position that said first electrostatic capacity generating portion is contacted to the developer accommodated in said developer accommodating portion when a predetermined amount of the developer is accommodated in said developer accommodating portion, said first electrostatic capacity generating portion generating an electrostatic capacity corresponding to an amount of the developer when said first electrostatic capacity generating portion is supplied with a voltage, and a second electrostatic capacity generating portion disposed at such a position that said second electrostatic capacity generating portion is not contacted to the developer accommodated in said developer accommodating portion, said second electrostatic capacity generating portion generating a reference electrostatic capacity, which is a developer-free electrostatic capacity, when said second electrostatic capacity generating portion is supplied with a voltage; and (c) an electrical contact for transmitting to the main assembly of said electrophotographic image forming apparatus a first electric signal corresponding to the electrostatic capacity generated by said first electrostatic capacity generating portion when the voltage is applied thereto from the main assembly of said electrophotographic image forming apparatus and a second electric signal corresponding to the reference electrostatic capacity generated by said second electrostatic capacity generating portion when a voltage is applied thereto from the main assembly of said electrophotographic image forming apparatus, when said developer supply container is mounted to the main assembly of said electrophotographic image forming apparatus.

55. A container according to claim 54, wherein said electrical contact is provided exposed from a container frame at two portions that are away from each other.

56. A container according to claim 54, wherein said developer supply container is detachably mountable to the main assembly of said electrophotographic image forming apparatus.

57. A container according to claim 54, wherein said first electrostatic capacity generating portion is disposed inside said developer accommodating portion, and said second electrostatic capacity generating portion is disposed outside said developer accommodating portion.

58. A container according to any one of claim 54 and 55, wherein said electrical contact includes a first electrical contact element for transmitting the first electric signal to the main assembly of said electrophotographic image forming apparatus and a second electrical contact element for transmitting the second electric signal to the main assembly of said electrophotographic image forming apparatus.

59. A container according to any one of claims 54–56, wherein said first electrostatic capacity generating portion and said second electrostatic capacity generating portion are disposed inside said developer accommodating portion.

60. A container according to claim 54, wherein said first electrostatic capacity generating portion includes a first electroconductive portion and a second electroconductive portion, wherein said second electrostatic capacity generating portion includes a third electroconductive portion and a fourth electroconductive portion, wherein said first electroconductive portion and said second electroconductive portion are juxtaposed with each other, and wherein said third electroconductive portion and said fourth electroconductive portion are juxtaposed with each other.

61. A container according to claim 60, wherein each of said first electroconductive portion and said second electroconductive portion includes portions that are arranged at regular intervals, and each of said third electroconductive portion and said fourth electroconductive portion includes portions that are arranged at regular intervals.

62. A container according to claim 61, wherein the regular interval portions of said first electroconductive portion and said second electroconductive portion are parallel with each other, and the regular interval portions of said third electroconductive portion and said fourth electroconductive portion are parallel with each other.

63. A container according to claim 60, 61 or 62, wherein said first electroconductive portion and said second electroconductive portion include alternatingly arranged portions, and wherein said third electroconductive portion and said fourth electroconductive portion include alternatingly arranged portions.

64. A container according to any one of claims 60–62, wherein said first electroconductive portion includes a base portion and a plurality of branched portions extended from the base portion, and said second electroconductive portion includes a base portion and a plurality of branched portions extended from the base portion of said second electroconductive portion, wherein said branched portions of said first electroconductive portion and the branched portions of said second electroconductive portion are alternatingly arranged in parallel with each other at regular intervals.

65. A container according to claim 64, wherein said first electroconductive portion and said second electroconductive portion include portions which are opposed to each other, wherein the branched portions of said first electroconductive portion are extended toward said second electroconductive portion, and the branched portions of said second electroconductive portion are extended toward said first electroconductive portion.

66. A container according to any one of claims 60–62, wherein said third electroconductive portion includes a base portion and a plurality of branched portions extended from the base portion, and said fourth electroconductive portion includes a base portion and a plurality of branched portions extended from the base portion of said fourth electroconductive portion, wherein said branched portions of said third electroconductive portion and the branched portions of said fourth electroconductive portion are alternatingly arranged in parallel with each other at regular intervals.

67. A container according to claim 66, wherein said third electroconductive portion and said fourth electroconductive portion include portions which are opposed to each other, wherein the branched portions of said third electroconductive portion are extended toward said fourth electroconductive portion, and the branched portions of said fourth electroconductive portion are extended toward said third electroconductive portion.

68. A container according to claim 54, wherein said first electrostatic capacity generating portion and said second electrostatic capacity generating portion have the same configuration.

69. A container according to any one of claims 54 and 68, wherein said first electrostatic capacity generating portion and said second electrostatic capacity generating portion generate the same electrostatic capacitances when voltages are applied thereto, when said first electrostatic capacity generating portion and said second electrostatic capacity generating portion are not contacted to the developer.

70. A measuring part for measuring an amount of a developer contained in a developer accommodating portion for an electrophotographic image forming apparatus for forming an image on a recording material, said measuring part comprising:

an insulative substrate;

a first electrostatic capacity generating portion disposed at such a position that said first electrostatic capacity generating portion is contacted to the developer accommodated in said developer accommodating portion when a predetermined amount of the developer is accommodated in said developer accommodating portion, said first electrostatic capacity generating portion generating an electrostatic capacity corresponding to an amount of the developer when said first electrostatic capacity generating portion is supplied with a voltage; and a second electrostatic capacity generating portion disposed at such a position that said second electrostatic capacity generating portion is not contacted to the developer accommodated in said developer accommodating portion, said second electrostatic capacity generating portion generating a reference electrostatic capacity, which is a developer-free electrostatic capacity, when said second electrostatic capacity generating portion is supplied with a voltage, wherein said first electrostatic capacity generating portion and said second electrostatic capacity generating portion are provided on said substrate.

71. A measuring part according to claim 70, wherein said first electrostatic capacity generating portion includes a first electroconductive portion and a second electroconductive portion, wherein said second electrostatic capacity generating portion includes a third electroconductive portion and a fourth electroconductive portion, wherein said first electroconductive portion and said second electroconductive portion are juxtaposed with each other, and wherein said third electroconductive portion and said fourth electroconductive portion are juxtaposed with each other.

72. A measuring part according to claim 71, wherein each of said first electroconductive portion and said second electroconductive portion includes portions that are arranged at regular intervals, and each of said third electroconductive portion and said fourth electroconductive portion includes portions that are arranged at regular intervals.

73. A measuring part according to claim 72, wherein the regular interval portions of said first electroconductive portion and said second electroconductive portion are parallel with each other, and wherein the regular interval portions of said third electroconductive portion and said fourth electroconductive portion are parallel with each other.

74. A measuring apart according to claim 71 or 72, wherein said first electroconductive portion and said second electroconductive portion include alternatingly arranged portions, and wherein said third electroconductive portion and said fourth electroconductive portion include alternatingly arranged portions.

75. A measuring part according to any one of claims 71–73, wherein said first electroconductive portion includes a base portion and a plurality of branched portions extended from the base portion, and said second electroconductive portion includes a base portion and a plurality of branched portions extended from the base portion of said second electroconductive portion, wherein said branched portions of said first electroconductive portion and the branched portions of said second electroconductive portion are alternatingly arranged in parallel with each other at regular intervals.

76. A measuring part according to claim 75, wherein said first electroconductive portion and said second electroconductive portion include portions which are opposed to each other, wherein the branched portions of said first electroconductive portion are extended toward said second electroconductive portion, and the branched portions of said second electroconductive portion are extended toward said first electroconductive portion.

77. A measuring part according to any one of claims 71–73, wherein said third electroconductive portion includes a base portion and a plurality of branched portions extended from the base portion, and said fourth electroconductive portion includes a base portion and a plurality of branched portions extended from the base portion of said fourth electroconductive portion, wherein said branched portions of said third electroconductive portion and the branched portions of said fourth electroconductive portion are alternatingly arranged in parallel with each other at regular intervals.

78. A measuring part according to claim 77, wherein said third electroconductive portion and said fourth electroconductive portion include portions which are opposed to each other, wherein the branched portions of said third electroconductive portion are extended toward said fourth electroconductive portion, and the branched portions of said fourth electroconductive portion are extended toward said third electroconductive portion.

79. A measuring part according to claim 70, wherein said first electrostatic capacity generating portion and said second electrostatic capacity generating portion have the same configuration.

80. A measuring part according to any one of claims 70 and 79, wherein said first electrostatic capacity generating portion and said second electrostatic capacity generating portion generate the same electrostatic capacitances when voltages are applied thereto, when said first electrostatic capacity generating portion and said second electrostatic capacity generating portion are not contacted to the developer.

81. A measuring part according to any one of claims 70–73, wherein said first electrostatic capacity generating portion and said second electrostatic capacity generating portion are disposed inside said developer accommodating portion.

82. A measuring part for measuring the amount of a developer contained in a developer accommodating portion for an electrophotographic image forming apparatus for forming an image on a recording material, said measuring part comprising:

an insulative substrate; and a first electrostatic capacity generating portion including first electroconductive portions and second electroconductive portions alternatingly arranged in parallel with each other at regular intervals and a second electrostatic capacity generating portion including third electroconductive portions and fourth electroconductive portions alternatingly arranged in parallel with each other at regular intervals, wherein said first electrostatic capacity generating portion and said second electrostatic capacity generating portion are provided on said insulative substrate.

83. A measuring part according to claim 82, wherein, said first and third electroconductive portions are electrically connected with each other, and are electrically connected to common electric input contact.

84. A measuring part according to claim 82, wherein said first electrostatic capacity generating portion has a portion where first electroconductive portions and said second electroconductive portions are arranged alternatingly in parallel with each other at regular intervals.

85. A measuring part according to claim 84, wherein said first electroconductive portions and said second electroconductive portions include respective branched portions extended toward each other.

86. A measuring part according to claim 82, 83 or 84, wherein said first electroconductive portions includes a base portion and a plurality of branched portions extended from the base portion, wherein said second electroconductive portions includes a base portion and a plurality of branched portions extended from the base portion of said second electroconductive portion, and wherein said branched portions of said first electroconductive portions and said branched portions of said second electroconductive portions are alternatingly arranged in parallel with each other at regular intervals.

87. A measuring part according to claim 85, wherein adjacent ones of the branched portions have substantially the same lengths.

88. A measuring part according to claim 82 or 83, wherein said third electroconductive portions and said fourth electroconductive portions include portions which are arranged alternatingly in parallel with each other at regular intervals.

89. A measuring part according to any one of claims 82 and 83, wherein said third electroconductive portions includes a base portion and a plurality of branched portions extended from the base portion, and said fourth electroconductive portions includes a base portion and a plurality of branched portions extended from the base portion, wherein said branched portions of said third electroconductive portions and the branched portions of said fourth electroconductive portions are alternatingly arranged in parallel with each other at regular intervals.

90. A measuring part according to claim 89, wherein said third electroconductive portions and said fourth electroconductive portions include respective branched portions extended toward each other.

91. A measuring part according to claim 89, wherein adjacent ones of said branched portions of said third electroconductive portion and said branched portions of said fourth electroconductive portions have substantially the same lengths.

92. A measuring part according to claim 91, wherein said first electroconductive portions as those of said second electroconductive portions have the same configurations and said third electroconductive portions and said fourth electroconductive portions, respectively.

93. A measuring part according to claim 82, wherein said first electrostatic capacity generating portion and said second electrostatic capacity generating portion generate the same electrostatic capacitances when voltages are applied thereto, when said first electrostatic capacity generating portion and said second electrostatic capacity generating portion are not contacted to the developer.

94. A measuring part according to claim 82, wherein said first electrostatic capacity generating portion and said second electrostatic capacity generating portion are disposed inside said developer accommodating portion.

95. A measuring part according to claim 82, wherein said measuring part is provided in a process cartridge, and when said process cartridge is mounted to a main assembly of said electrophotographic image forming apparatus, said measuring part outputs to the main assembly of said electrophotographic image forming apparatus an electric signal corresponding to an amount of the developer accorded in the developer accommodating portion of said process cartridge.

96. A measuring part according to claim 82, wherein said measuring part is provided in a developer supply container, and when said developer supply container is mounted to a main assembly of said electrophotographic image forming apparatus, said measuring part outputs to the main assembly of said electrophotographic image forming apparatus an electric signal corresponding to an amount of the developer accommodated in the developer accommodating portion of said developer supply container.

* * * * *

UNITED STATES PATENT AND TRADEMARK OFFICE

CERTIFICATE OF CORRECTION

PATENT NO. : 6,463,223 B1
DATED : October 8, 2002
INVENTOR(S) : Toshiyuki Karakama et al.

It is certified that error appears in the above-identified patent and that said Letters Patent is hereby corrected as shown below:

Title page,
Item [57], ABSTRACT,
Line 6, “generates” should read -- generating --; and “generating” should read -- generates --.

Column 2,
Line 43, “developer accommodating” should read -- developer-accommodating --.
Line 66, “father” should read -- further --.

Column 5,
Line 18, “the” should read -- a --.

Column 7,
Line 2, “is” should be deleted.

Column 10,
Line 20, “above described” should read -- above-described --.
Line 64, “he” should read -- the --.

Column 11,
Line 40, “the” (second occurrence) should be deleted.

Column 12,
Line 50, “or” should be deleted.
Line 62, “and” should read -- as --.

Column 13,
Line 34, “constant” should read -- a constant --.

Column 19,
Line 3, “contacting” should read -- contacted to --.
Line 37, “said wherein” should read -- wherein said --.

Column 20,
Line 19, “claim 8” should read -- claim 8, --.

Column 22,
Line 16, “the” should be deleted.

UNITED STATES PATENT AND TRADEMARK OFFICE

CERTIFICATE OF CORRECTION

PATENT NO. : 6,463,223 B1
DATED : October 8, 2002
INVENTOR(S) : Toshiyuki Karakama et al.

It is certified that error appears in the above-identified patent and that said Letters Patent is hereby corrected as shown below:

Column 23,
Line 44, “An” should read -- A --.

Column 24,
Line 57, “detection” should read -- detecting --.

Column 31,
Line 7, “apart” should read -- part --.

Signed and Sealed this

Twenty-seventh Day of May, 2003

JAMES E. ROGAN
*Director of the United States Patent and Trademark Office*